US008326201B2

(12) United States Patent
Hosokawa et al.

(10) Patent No.: US 8,326,201 B2
(45) Date of Patent: Dec. 4, 2012

(54) FIXING APPARATUS WITH ENDLESS BELT AND CURVED PRESSING MEMBER

(75) Inventors: Takahiro Hosokawa, Kawasaki (JP); Kazuhisa Kemmochi, Suntou-gun (JP); Hikaru Osada, Kamakura (JP); Keisuke Abe, Kawasaki (JP); Tsutomu Miki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 449 days.

(21) Appl. No.: 12/683,631

(22) Filed: Jan. 7, 2010

(65) Prior Publication Data

US 2010/0172677 A1 Jul. 8, 2010

(30) Foreign Application Priority Data

Jan. 8, 2009 (JP) ..... 2009-002379

(51) Int. Cl.
*G03G 15/20* (2006.01)

(52) U.S. Cl. ..... 399/329

(58) Field of Classification Search ..... 399/328, 399/329

See application file for complete search history.

(56) References Cited

U.S. PATENT DOCUMENTS

| | | | | |
|---|---|---|---|---|
| 6,459,878 | B1 | 10/2002 | Tomoyuki et al. | |
| 7,962,084 | B2 * | 6/2011 | Tanaka et al. | 399/329 |
| 8,080,359 | B2 * | 12/2011 | Matsubara et al. | 399/329 |
| 8,126,384 | B2 * | 2/2012 | Baba | 399/329 |
| 2008/0166653 | A1 | 7/2008 | Matsubara et al. | 430/124.32 |

FOREIGN PATENT DOCUMENTS

| | | |
|---|---|---|
| JP | 8-123241 | 5/1996 |
| JP | 10-198204 | 7/1998 |
| JP | 10-228195 | 8/1998 |
| JP | 10-228200 | 8/1998 |
| JP | 2001-356625 | 12/2001 |
| JP | 2006-78578 | 3/2006 |
| JP | 2006-91214 | 4/2006 |
| JP | 2006-91501 | 4/2006 |
| JP | 2007-72364 | 3/2007 |
| JP | 2008-191652 | 8/2008 |
| JP | 2008-241843 | 10/2008 |

* cited by examiner

*Primary Examiner* — William J Royer
(74) *Attorney, Agent, or Firm* — Fitzpatrick, Cella, Harper & Scinto

(57) ABSTRACT

A fixing apparatus for heat-fixing an unfixed toner image formed on a sheet, includes a roller; an endless belt contacted to the roller; a pressing member contacted to an inner surface of the endless belt and cooperating with the roller to nip the endless belt, wherein the sheet on which the unfixed toner image is formed is heated while being nipped and fed by a nip between the roller and the endless belt, wherein such a surface of the pressing member as is opposed to the inner surface of the endless belt is curved substantially in the same direction as a curved surface of the roller, wherein the nip includes a first nip region in which the endless belt is not pressed by the pressing member and the endless belt is contacted to the roller by an elastic force of the endless belt which is in a slack state, and a second nip region in which the endless belt is contacted to the roller by pressing of the pressing member, wherein the nip starts with the first nip region with respect to a feeding direction of the sheet, wherein the second nip region is continuous with the first nip region.

5 Claims, 9 Drawing Sheets

FIXING APPARATUS WITH ENDLESS BELT AND CURVED PRESSING MEMBER

FIELD OF THE INVENTION AND RELATED ART

The present invention relates to a fixing apparatus (fixing device) mounted in an image forming apparatus such as an electrophotographic copying machine, an electrophotographic printer, and the like.

As a fixing apparatus mounted in an image forming apparatus such as an electrophotographic copying machine, printer, and the like, there is a fixing apparatus of the belt type. A fixing apparatus of the belt type uses a flexible endless belt to form a nip through which recording media, such as a sheet of recording paper, an OHP sheet, and the like, which is bearing a toner image, is conveyed while remaining pinched in the nip. Therefore, a fixing apparatus of the belt type can make its nip wider in the direction parallel to the recording medium conveyance direction than a fixing apparatus which uses only rollers. Thus, even if it is increased in recording medium conveyance speed, it can still heat toner (toner image) for a sufficient length of time, making it possible to increase an image forming apparatus in printing speed.

Japanese Laid-open Patent Applications 2001-356625, and 2006-091501 disclose fixing apparatuses made up of a combination of an endless belt and a roller.

FIG. 13 is a schematic cross-sectional drawing of the fixing apparatus disclosed by Japanese Laid-open Patent Application 2001-356625, and shows the structure of the fixing apparatus.

This fixing apparatus has a fixation roller 1, a pressure pad 4, a pressure belt 2, and a halogen heater 5. The fixation roller 1 has an elastic layer 16, which is its outermost layer. The elastic layer 16 is formed of rubber. The pressure belt 2 is an endless belt, and is suspended in such a manner that it is held against the peripheral surface of the fixation roller 1 by the pressure pad 4, creating a fixation nip N (fixation nip), while it is moved between the fixation roller 1 and the pressure pad 4. The halogen heater 5 is in the fixation roller 1. The pressure pad 4 is formed of such a substance that it is low in thermal conductivity and is harder than the elastic layer 1*b* of the fixation roller 1. For example, it is formed of a heat resistant resin or ceramic. After the formation of an unfixed toner image T on a sheet of recording medium P, the sheet of recording medium P (which hereafter will be referred to simply as recording medium P) is conveyed through the fixation nip N of the fixing apparatus in the direction indicated by an arrow mark C. As the recording medium P is conveyed through the fixation nip N, the unfixed toner image T is thermally fixed to the surface of the recording medium P.

In a case where a sheet of thick and coated paper or the like is used as a recording medium for the fixing apparatus in FIG. 13, it is possible that a phenomenon called "image deviation", that is, such a phenomenon that an unfixed toner image on the recording medium becomes partially displaced while being fixed, and/or a phenomenon called "glossiness nonuniformity", that is, such a phenomenon that an image becomes nonuniform in glossiness, will occur. Next, the reason for the occurrence of these phenomena will be explained with reference to FIGS. 14-16.

FIG. 14 is a sectional drawing of the fixation nip N of the fixing apparatus in FIG. 13, and shows the state of fixation nip N when the sheet of coated thin paper (80 g/m$^2$, for example, in basic weight) is being conveyed through the fixation nip N.

Referring to FIG. 14, in a case where a sheet of recording medium P is thin, the pressure (nip pressure) in the fixation nip N is hardly increased by the introduction of the recording medium P into the fixation nip N. Thus, the portion of the elastic layer 1*b*, which is being in the fixation nip N, remains uniform in deformation across the entirety of the fixation nip N. That is, it does not occur that the inward portion of the fixation nip N, in terms of the recording medium conveyance direction, becomes lower in pressure than the edge portions of the fixation nip N.

FIG. 15 is a sectional drawing of the fixation nip N of the fixing apparatus in FIG. 13, and shows the state of fixation nip N when a sheet of coated thick paper (300 g/m$^2$, for example, in basic weight) is being conveyed through the fixation nip N.

While a sheet of coated thick paper is conveyed through the fixation nip N, the portion of the pressure pad 4, which comes into contact with the sheet, remains virtually unchanged in shape; its curvature remains virtually matched with the curvature of the peripheral surface of the fixation roller 1 as is shown in FIG. 15. However, the elastic layer 1*b* of the fixation roller 1 is substantially changed in shape by the sheet. More concretely, because of the thickness of the sheet of coated thick paper, the edge portions of the elastic layer 1*b*, in terms of the rotational direction A of the fixation roller 1, become substantially different in cross-sectional shape from the center portion of the elastic layer 1*b*. Thus, the fixation nip N changes in pressure distribution in such a manner that its pressure is higher across its edge portions than across its center portion, as shown in FIG. 15.

FIG. 16 is a graphical drawing which shows the pressure distribution in the fixation nip N of the fixing apparatus in FIG. 13.

The pressure distribution in the fixation nip N was measured with the use of a pressure distribution measuring system PINCH (Nitta Co., Ltd). FIG. 16 comparatively shows three pressure distributions, that is, the pressure distributions when only the pressure sensor was conveyed through the fixation nip N, when a combination of the pressure sensor and a sheet of coated thin paper (80 g/m$^2$ in basic weight) was conveyed through the fixation nip N, and when a combination of the pressure sensor and a sheet of coated thick paper (800 g/cm$^2$) was conveyed through the fixation nip N.

Because of the presence of the sheet, the internal pressure of the fixation nip N when the combination of the pressure sensor and a sheet of coated thin paper (80 g/m$^2$ in basic weight) was conveyed through the fixation nip N is greater than the internal pressure of the fixation nip N when the pressure sensor alone was conveyed through the fixation nip N. However, it did not occur that the pressure becomes lower across a certain portion of the fixation nip N in the recording medium conveyance direction.

On the other hand, the pressure distribution in the fixation nip N when a sheet of coated thick paper is conveyed through the fixation nip N is substantially affected by the presence of the recording medium. That is, the pressure distribution becomes such that the internal pressure of the fixation nip N is higher across the end portions of the fixation nip N in terms of the direction C in which the sheet is conveyed through the fixation nip N, and lower across the center portion of the fixation nip N. In other words, while a sheet of coated thick paper is conveyed through the fixation nip N, the center portion of the fixation nip N, in terms of the recording medium conveyance direction C, reduces in pressure. Such a phenomenon, as this one, that as a sheet of recording medium is conveyed through the fixation nip N, the entrance portion of the fixation nip N becomes higher in pressure than the following portion (center portion) of the fixation nip N, is generally called "pressure dip".

"Pressure dip", such as the above-described one, occurs when the toner image on a sheet of coated paper, which is low in air permeability, is fixed. Thus, as a sheet of coated recording paper, which is low in air permeability, is conveyed through the fixation nip N, not only the air and/or water vapor in the fixation nip N, remains in the "pressure dipped" portion of the fixation nip N, and creates gaps between the sheet of coated recording paper and fixation roller 1, but also, disturbs the toner image before the toner image becomes fixed. Therefore, "image deviation", which is such a phenomenon that a part or parts of the toner image are displaced as they are fixed, and/or "glossiness nonuniformity", which is attributable to the instability in the contact between the fixation roller 1 and the sheet of coated paper, is likely to occur. That is, "pressure dip" is likely to cause the formation of abnormal images.

A sheet of ordinary recording paper is relatively large in air permeability. Therefore, when a sheet of ordinary recording paper is used as the recording medium, the air and water vapor in the fixation nip N are allowed to escape. Therefore, it is thought that when a sheet of ordinary recording paper is used as the recording medium, "image deviation" and "glossiness nonuniformity" do not occur often.

FIG. 17 is a schematic cross-sectional drawing of the fixing apparatus disclosed in Japanese Laid-open Patent Application 2006-091501, and shows the structure of the fixing apparatus.

This fixing apparatus is made up of a fixation roller 1, a tension roller 22, and a pressure belt 2. The fixation roller 1 has an elastic layer 1*b*, as the peripheral layer, which is formed of rubber. The pressure belt 2 is disposed so that the peripheral surface of the fixation roller 1 is partially wrapped by the pressure belt 2, and also, that the pressure belt 2 is provided a preset amount of tension by the tension roller 22. The fixation nip N of this fixing apparatus is between the pressure belt 2 and fixation roller 1.

The pressure belt 2 is suspended by three rollers, that is, a separation roller 21, an entrance roller 23, and the tension roller 22, in a manner to partially wrap around them. The separation roller 21 and pressure pad 4 are kept pressed against the fixation roller 1, creating the fixation nip N, which is substantially wider than that of a fixing apparatus of the roller type.

FIG. 18 is a graphical drawing which shows the pressure distribution of the fixation nip N of the fixing apparatus in FIG. 17.

The fixing apparatus in FIG. 17 backs up its base plate 4*b* by an elastic pad 4*p*. Thus, "pressure dip" does not occur. That is, while a sheet of coated thick paper is conveyed through the fixation nip N, the internal pressure of the fixation nip N does not reduce. This is why this fixing apparatus employs these two members, which are the separation roller 21 and pressure pad 4. With the employment of these two members, not only does this fixing apparatus form the fixation nip N, which is substantially wider than that of a fixing apparatus which does not employ the two members, but also, provides the fixation nip N with a pressure distribution which does not have "pressure dip" between its entrance to its exit, as will be evident from the pressure distribution in FIG. 18.

As the method for dealing with a wide range of recording mediums in terms of thickness, from a sheet of thin recording medium (paper) to a sheet of thick recording medium, this fixing apparatus is structured so that its pressure pad 4 is changeable in the angle of contact relative to its fixation roller 1 to change its pressure distribution, as shown in FIG. 17. More concretely, when the fixing apparatus is in the mode for a sheet of thin recording paper, it is kept reduced in the internal pressure of its fixation nip N, and also, in the width of its fixation nip N, to prevent "hot offset". On the other hand, when the fixing apparatus is in the mode for a sheet of thick recording paper, its pressure pad 4 is tilted so that the nip entrance side of the pressure pad 4 becomes lifted to make the nip entrance side higher in pressure. Shown in FIG. 18 is the pressure distribution of the fixation nip N in the abovementioned two modes.

As will be evident from the pressure distributions in FIG. 18, in the case of this fixing apparatus structured as described above, even when a sheet of coated thick recording paper is conveyed through the fixation nip N, "pressure dip" does not occur in the fixation nip N, and therefore, "image deviation" and "glossiness nonuniformity" do not occur.

The reason why these unwanted phenomena do not occur is as follows. The elastic portion of the pressure pad 4 is deformed by the sheet of thick recording paper. Therefore, the portion of the elastic layer 1*b* of the fixation roller 1, which is in the fixation nip N, is evenly deformed across the entire range of the fixation nip N.

As described above, what is necessary to prevent "image deviation" and "glossiness nonuniformity" is to structure a fixing apparatus so that the "pressure dip" does not occur in the fixation nip N, that is, to structure a fixing apparatus so that the internal pressure distribution of the fixation nip N becomes such that the internal pressure is lowest at the entrance of the fixation nip N, and gradually increases toward the exit.

However, both the fixing apparatus in FIG. 13 and the fixing apparatus in FIG. 17 suffer from the following problem. That is, they are structured so that while a sheet of recording paper is conveyed from the fixation nip entrance to the fixation nip exit, not only is it continuously heated, but also, a relatively large amount of pressure is continuously applied to the sheet of recording paper. Therefore, the toner image on the sheet of recording paper excessively penetrates through the sheet of recording paper. Consequently, the paper fibers appear at the surface of the toner image, reducing thereby the toner image in density.

For example, in the case of the fixing apparatus in FIG. 13, it is structured so that the entirety of its fixation nip N is the range in which the fixation pressure is generated by the fixation roller 1 and pressure pad 4, and also, so that the pressure is continuously applied to a toner image while the toner image is conveyed from the fixation nip entrance to the fixation nip exit. Also in the case of the fixing apparatus in FIG. 17, the portion of the pressure belt 2, which is in contact with the elastic pad 4*p*, is under a large amount of pressure, needless to say. Further, in the case of the fixing apparatus in FIG. 17, the pressure belt 2, which remains tensioned by the tension roller 22, is in contact with the fixation roller 1 in the portion of the fixation nip N, which is on the upstream side of its portion which is in contact with the elastic pad 4*p*, and in which the pressure belt 2 is not in contact with the elastic pad 4*p*. Therefore, a relatively large amount of pressure is between the pressure belt 2 and fixation roller 1.

In other words, the fixing apparatus in FIG. 17 is also structured so that while a sheet of recording medium (paper) is conveyed through the fixation nip N, a relatively large amount of pressure is continuously applied to the sheet of recording medium from the fixation nip entrance to the fixation nip exit.

SUMMARY OF THE INVENTION

The present invention was made in consideration of the above-described problems, and its primary object is to provide a fixing apparatus which does not reduce a toner image in density while it is fixing the toner image.

According to an aspect of the present invention, there is provided a fixing apparatus for heat-fixing an unfixed toner image formed on a recording material, the fixing apparatus comprising a rotatable roller; an endless belt contacted to the roller; a pressing member contacted to an inner surface of the endless belt and cooperating with the roller to nip the endless belt, wherein the recording material on which the unfixed toner image is formed is heated while being nipped and fed by a nip between the roller and the endless belt, wherein such a surface of the pressing member as is opposed to the inner surface of the endless belt is curved substantially in the same direction as a curved surface of the roller, wherein the nip includes a first nip region in which the belt is not pressed by the pressing member and the endless belt is contacted to the roller by an elastic force of the endless belt which is in a slack state, and a second nip region in which the endless belt is contacted to the roller by pressing of the pressing member, and wherein the nip starts with the first nip region with respect to a feeding direction of the recording material, wherein the second nip region is continuous with the first nip region.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

(1-1) Example of Image Forming Apparatus

Figure 12:
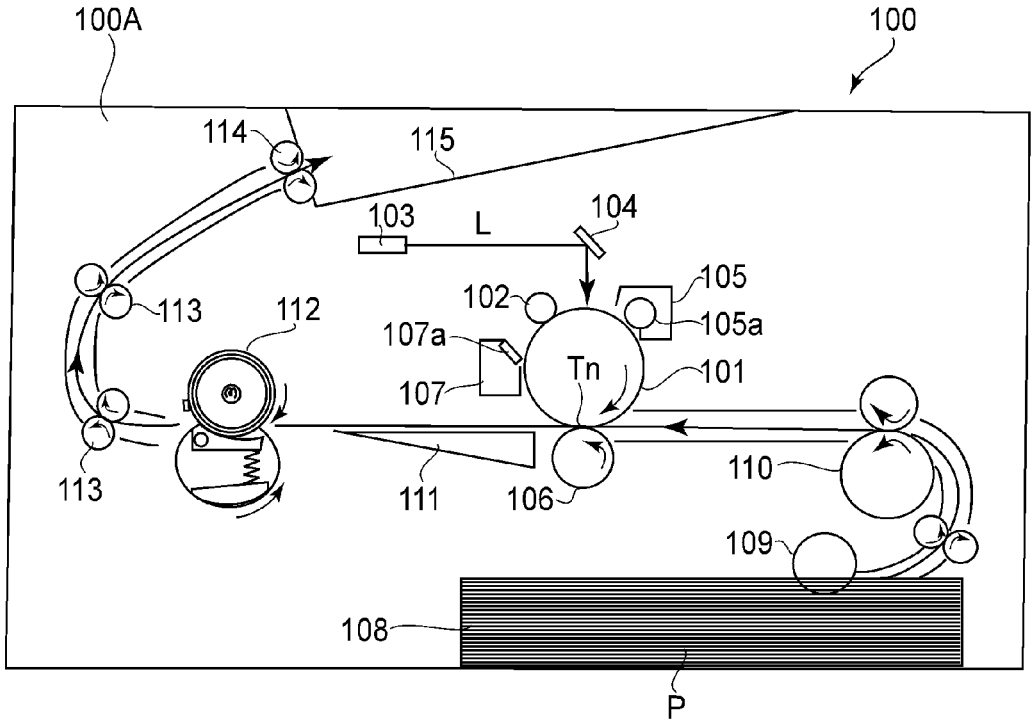
FIG. 12 is a sectional drawing of an example of an image forming apparatus, and shows the structure of the image forming apparatus.

FIG. 12 is a schematic drawing of an example of an image forming apparatus 100 having a fixing apparatus 112 in accordance with the present invention. This image forming apparatus 100 is a laser beam printer which forms an image on a recording medium (for example, sheet of recording medium, OHP sheet, and the like), using an electrophotographic image forming method.

The image forming apparatus 100 in this preferred embodiment of the present invention has an electrophotographic photosensitive member 101 as an image bearing member. The electrophotographic photosensitive member 101 is in the form of a drum (and therefore, it will be referred to as photosensitive drum 101 hereafter). The photosensitive drum 101 is rotatably supported by the primary frame of main assembly 100A of the image forming apparatus 100, and is rotationally driven by a driving means (unshown) in the direction indicated by an arrow mark, at a preset process speed. The image forming apparatus 100 has also a charge roller 102 (charging means), a laser exposing apparatus 103 (exposing means), a developing apparatus 105 (developing means), a transfer roller 106 (transferring means), and a cleaning apparatus 107 (cleaning means), which are disposed in the listed order in the adjacencies of the peripheral surface of the photosensitive drum 101.

While the photosensitive drum 101 is rotated, the peripheral surface of the photosensitive drum 101 is uniformly charged to a preset potential level and polarity by the charge roller 102. Then, the peripheral surface of the photosensitive drum 101 is exposed by the laser exposing apparatus 103; the peripheral surface of the photosensitive drum 101 is scanned by a beam of laser light L projected upon the peripheral surface from the laser exposing apparatus 103 by way of a mirror 104, and the like, while being modulated with the information of the image to be formed. Thus, electrical charge is removed from the exposed (scanned) points of the charged peripheral surface of the photosensitive drum 101. Consequently, an electrostatic latent image (electrostatic image), which reflects the image information, is formed on the peripheral surface of the photosensitive drum 101. The electrostatic latent image is developed with toner (developer) by the developing apparatus 105 which has a development roller 105*a*. That is, the developing apparatus 105 causes toner to adhere to the electrostatic latent image on the peripheral surface of the photosensitive drum 101 by applying a development bias to the development roller 105*a*. As a result, the electrostatic latent image is turned into a visible image, or an image formed of toner (developer image).

Meanwhile, a sheet of recording medium (paper) P is fed into the main assembly 100A of the image forming apparatus 100, with a preset timing, from a recording medium feeder cassette 108 by a feeder-and-conveyer roller 109. Then, the sheet of recording medium P is conveyed by a pair of conveyance rollers 110 to a transfer nip Tn, which is the nip between the photosensitive drum 101 and transfer roller 106. Then, the sheet of recording medium P is conveyed through the transfer nip Tn while remaining pinched between the photosensitive drum 101 and transfer roller 106. While the sheet of recording medium P is conveyed through the transfer nip Tn, a transfer bias is applied to the transfer roller 106. Thus, the toner image on the peripheral surface of the photosensitive drum 101 is transferred onto the sheet of recording medium P as if it is peeled away from the peripheral surface of the photosensitive drum 101.

After bearing the toner image in the transfer nip Tn, the sheet of recording medium P (which hereafter may be referred to simply as recording medium P) is separated from the peripheral surface of the photosensitive drum 101, and is conveyed along a recording medium conveyance guide 111 to the fixing apparatus 112, which thermally fixes the toner image to the surface of the recording medium P by applying heat and pressure to the toner image on the recording medium P. After coming out of the fixing apparatus, the recording medium P is conveyed by roller pairs 113, 113 to a pair of discharge rollers 114. Then, it is discharged by the discharge rollers 114 onto a delivery tray 115, which is a part of the top surface of the main assembly 100A of the image forming apparatus 100.

After the transfer of the toner image, the peripheral surface of the photosensitive drum 101 is cleaned by the cleaning apparatus 107; adherents, such as the transfer residual toner, on the peripheral surface of the photosensitive drum 101 are removed by a cleaning blade 107*a* of the cleaning apparatus 107 to prepare the peripheral surface of the photosensitive drum 101 for the following image formation cycle.

(1-2) Fixing Apparatus

In the following description of the fixing apparatus 112, the lengthwise direction of the fixing apparatus 112, and the lengthwise direction of the structural components the fixing apparatus 112, are the direction which is parallel to the surface of the recording medium P and is perpendicular to the recording medium conveyance direction C. The widthwise direction therefor is the direction which is parallel to the surface of the recording medium P and is parallel to the recording medium conveyance direction C. The "width" of the recording medium P means the measurement of the shorter edge of the recording medium P.

Figure 1:
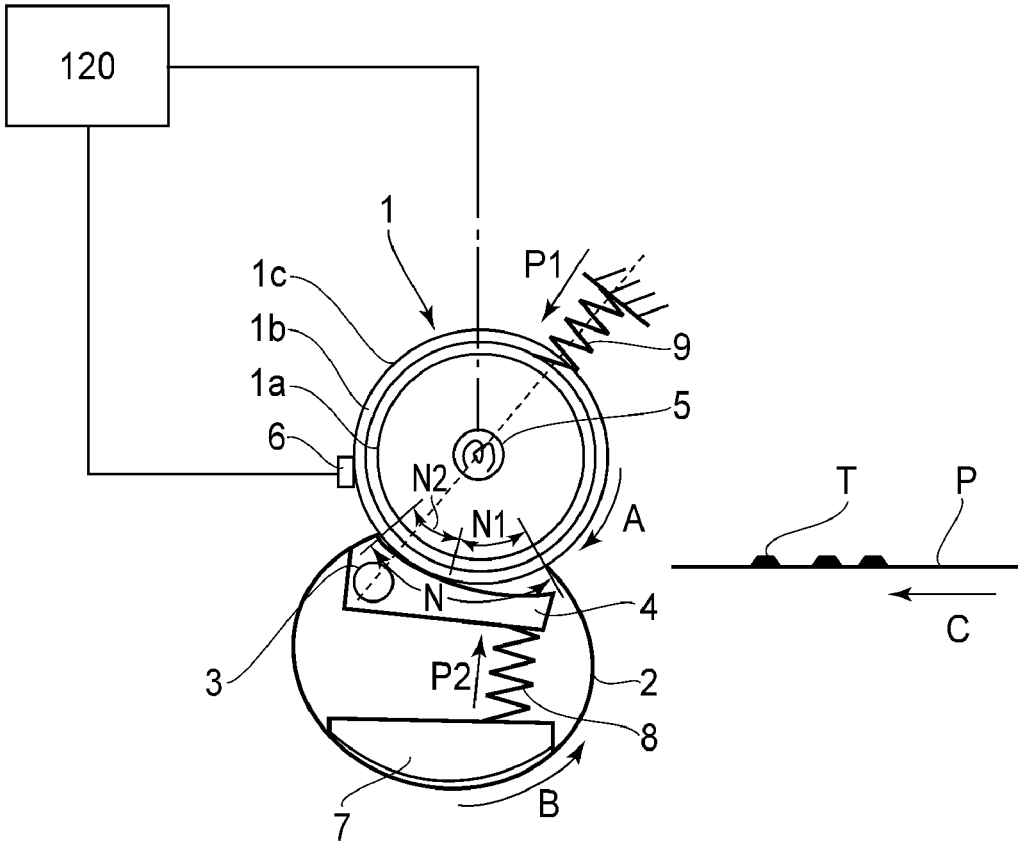
FIG. 1 is a sectional drawing of a fixing apparatus in the first preferred embodiment of the present invention.
Figure 2:
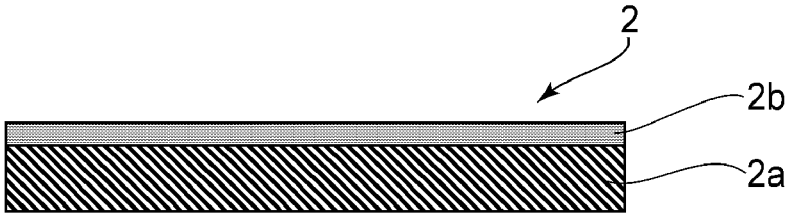
FIG. 2 is a sectional drawing of a pressure belt of the fixing apparatus in the first preferred embodiment of the present invention, and shows the laminar structure of the pressure belt.
Figure 3:
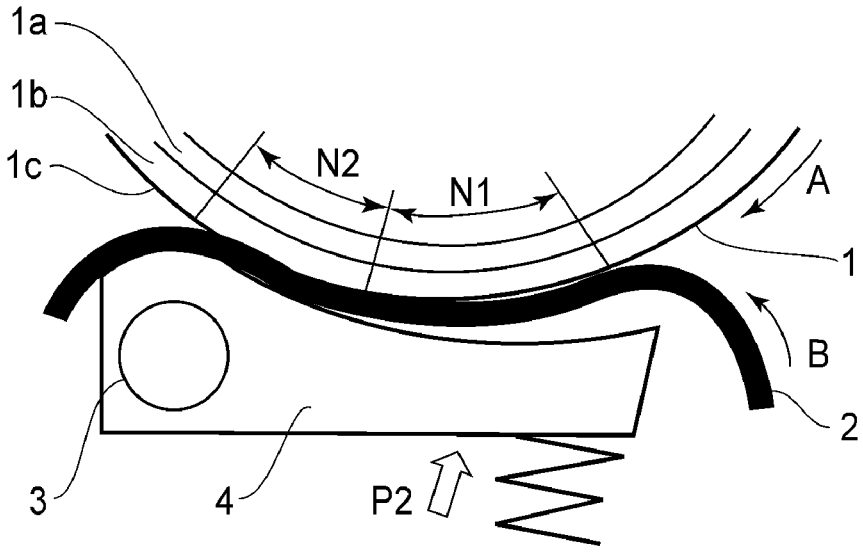
FIG. 3 is a sectional drawing of a pre-nip and pressure nip of the fixing apparatus in the first preferred embodiment of the present invention.

FIG. 1 is a schematic sectional drawing of the fixing apparatus 112 in the first preferred embodiment of the present invention. FIG. 2 is a sectional drawing of the pressure belt 2 of the fixing apparatus 112 in the first preferred embodiment of the present invention, and shows the laminar structure of the pressure belt 2. FIG. 3 is a schematic sectional drawing of the pre-nip N1 and pressure nip N2 of the fixing apparatus 112 in the first preferred embodiment of the present invention, and shows the state of contact between the fixation roller 1 and pressure belt 2 in the pre-nip N1 and pressure nip N2.

The fixing apparatus 112 in this embodiment has: the fixation roller 1 as a rotatable roller; the pressure belt 2 which is an endless belt; a pressure pad 4 as a pressure applying member; a halogen heater 5 as a heating means (heating member); and a belt guide 7; etc. The fixation roller 1, pressure belt 2, pressure pad 4, heater 5, and belt guide 7 are all long and narrow members, the lengthwise direction of which is parallel to the abovementioned lengthwise direction of the fixing apparatus 112.

(1-2-1) Description of Fixation Roller

The fixation roller 1 is made up of a metallic core 1*a*, an elastic layer 1*b*, and a separation layer 1*c*. The metallic core 1*a* is made of iron, and is a hollow and cylindrical member which is 37.5 mm in internal diameter, 38.5 mm in external diameter, and 0.5 mm in wall thickness. The elastic layer 1*b* is formed of silicone rubber, and is 0.5 mm in thickness. It covers the entirety of the peripheral surface of the metallic core 1*a* except for the lengthwise end portions of the metallic core 1*a*. The separation layer 1*c* covers the peripheral surface of the elastic layer 1*b* to a thickness in a range of 10-50 μm. It is formed of a fluorinated resin, such as PFA, PTFE, and the like. This fixation roller 1 is 40 mm in external diameter. The inward surface of the metallic core 1*a* of the fixation roller 1 is coated black to make it easier for the metallic core 1*a* to absorb the radiant heat from the heater 5 disposed in the hollow of the metallic core 1*a*. The fixation roller 1 is rotatably supported at its lengthwise end portions by a frame (unshown) of the fixing apparatus 112, with the presence of bearings between the metallic core 1*a* and the frame.

(1-2-2) Description of Pressure Belt (Endless Belt)

The endless belt 2 has: a substrate layer 2*a* which is endless; and a separation layer 2*b* which covers the entirety of the outward surface of the substrate layer 2*a*. That is, the surface of the substrate layer 2*a*, which faces the fixation roller 1, is covered with the separation layer 2*b*. The substrate layer 2*a* is electrically furnaced of such a metal as nickel, SUS (stainless steel), or formed of such a heat resistance resin as polyimide. If the substrate layer 2*a* is an electrically furnaced metallic belt, its thickness is in a range of 50-150 μm. If it is formed of a heat resistant resin, its thickness is in a range of 50-300 μm. Thus, the endless belt 2 is provided with a proper amount of rigidity (stiffness). The separation layer 2*b* is roughly 10-50 μm in thickness, and is formed of a fluorinated resin, such as PFA, PTFE (polytetrafluoroethylene). It is in the form of a piece of tube which wraps around the pressure belt 2, or coated on the outward surface of the substrate layer 2*a*. The pressure belt 2 is suspended in such a manner that it loosely contacts the pressure pad 4 and belt guide 7. That is, the pressure belt 2 is not tensioned by a tension roller or the like, being therefore loosely fitted. The external diameter of the pressure belt 2 is 40 mm. Its length is roughly the same as that of the fixation roller 1.

(1-2-3) Description of Pressure Pad (Pressure Applying Member) and Belt Guide)

The pressure pad 4 is formed so that its length is the same as that of the pressure belt 2. It is disposed so that it applies pressure on the fixation roller 1, with the presence of pressure belt 2 between the pressure pad 4 and fixation roller 1. It has a pressure pad shaft 3 (rotational axis), which is on the exit side in terms of recording medium conveyance direction C (downstream side in terms of recording medium conveyance direction). The pressure pad 4 is enabled to freely rotate about this pressure pad shaft 3. The pressure pad shaft 3 is rotatably supported at its lengthwise ends, with the presence of bearings between the pressure pad shaft 3 and the apparatus frame. As the material for the pressure pad 4, a substance which is low in thermal conductivity, and is harder than the material for the elastic layer 1*b* of the fixation roller 1, is used. In this embodiment, a heat resistance resin or ceramic is used as the material for the pressure pad 4.

The surface layer of the pressure pad 4, which remains in contact with the inward surface of the pressure belt 2, is formed of fluorinated resin, such as PFA, PTFE (polytetrafluoroethylene), and is roughly 10-50 μm in thickness. This surface layer is provided to reduce the frictional resistance between the surface of the pressure pad 4 and the inward surface of the pressure belt 2. Incidentally, in order to reduce the frictional resistance between the surface of the pressure pad 4 and the inward surface of the pressure belt 2, a heat resistant lubricant such as fluorinated grease or the like may be coated on the inward surface of the pressure belt 2.

The surface of the pressure pad 4, which faces the fixation roller 1 (surface of pressure pad 4, which faces inward surface of pressure belt 2), is provided with such a curvature that matches the curvature of the peripheral surface of the fixation roller 1 (its curvature is the same in direction as that of fixation roller 1). More concretely, the radius of curvature of the abovementioned surface of the pressure pad 4 is 35 mm, which is larger than the radius (20 mm) of the peripheral surface of the fixation roller 1.

The belt guide 7 is below the pressure pad 4, and is disposed so that it opposes the pressure pad 4. It is held by the apparatus frame, at its length lengthwise ends. The surface of the belt guide 7, which is in contact with the inward surface of the pressure belt 2, is provided with such a curvature that matches that of the inward surface of the pressure belt 2.

Figure 4:
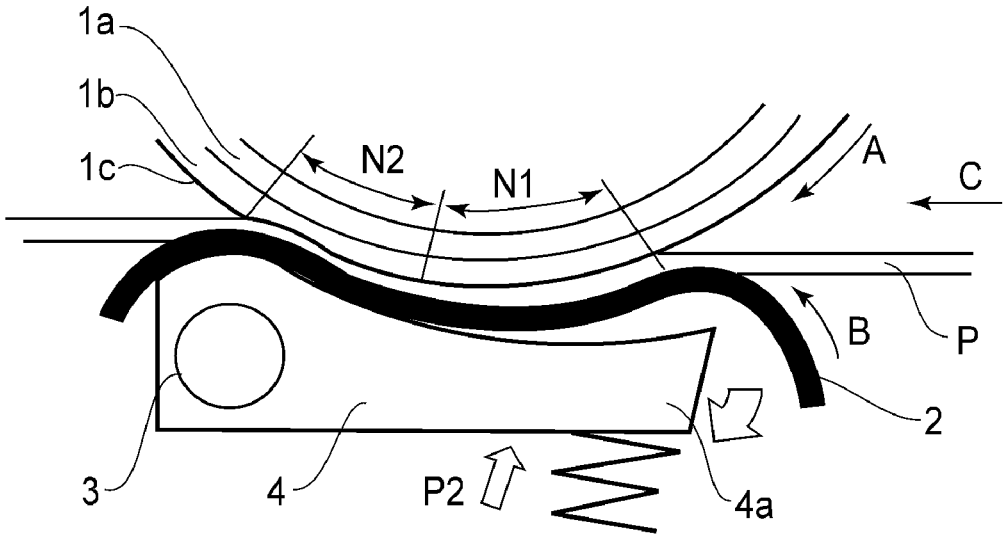
FIG. 4 is a sectional drawing of a fixation nip of the fixing apparatus, in the first preferred embodiment of the present invention, while a sheet of thin recording paper is conveyed through the fixation nip.
Figure 5:
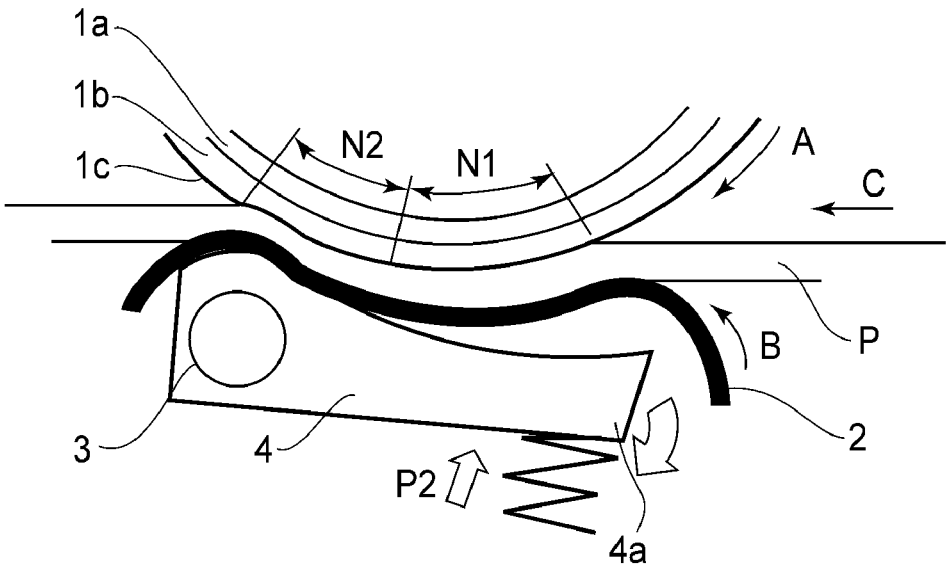
FIG. 5 is a sectional drawing of a fixation nip of the fixing apparatus, in the first preferred embodiment of the present invention, while a sheet of thick recording paper is conveyed through the fixation nip.

The entrance portion (upstream portion) of the pressure pad 4, in terms of recording medium conveyance direction C, is kept slightly pressed in the direction (which is perpendicular to recording medium conveyance direction) indicated by an arrow mark P2 in FIG. 1, by springs 8 provided between the pressure pad 4 and belt guide 7. This setup allows an entrance side 4*a* of the pressure pad 4, in terms of the recording medium conveyance direction C, to rotationally move about the pressure pad shaft 3, in proportion to the thickness of the recording medium P, as the recording medium P is conveyed through (introduced into) a fixation nip N (FIG. 1), which will be described later (FIGS. 4 and 5). Further, there are springs 9 between the bearings of the fixation roller 1 and the apparatus frame, and the fixation roller 1 is kept strongly pressed against the pressure pad shaft 3 by the springs 9 in the direction indicated by an arrow mark P1 (direction perpendicular to rotational axis of fixation roller 1 and rotational axis of pressure pad shaft 3). In the first preferred embodiment, the amount of the pressure applied in the direction indicated by the arrow mark P1 was set to roughly 392 N (40 kgf), and the amount of the pressure applied in the direction indicated by the arrow mark P2 was set to roughly 49 N (5 kgf).

(1-2-4) Pressure Nip (Second Nip) and Pre-nip (First Nip)

Referring to FIG. 1, the pressure pad 4 is kept pressed in the direction of the arrow mark P2, and the fixation roller 1 is kept pressed in the direction of the arrow mark P1. Thus, the pressure nip N2 is formed by the contact between the pressure belt 2 and fixation roller 1. The pressure belt 2 has a proper amount of rigidity (stiffness) as described above. Therefore, the pressure belt 2 contacts the peripheral surface of the fixation roller 1 across the area from the slightly entrance side of the pressure nip N2, in terms of the recording medium conveyance direction C, and to the downstream end of the pressure nip N2. With the provision of this structural arrangement, the pressure belt 2 remains deformed by a proper amount while remaining in balance in terms of the circumference direction of the fixation roller 1. Thus, the pre-nip N1 is formed across the area of the pressure belt 2, which is in contact with the peripheral surface of the fixation roller 1. Therefore, the nip pressure in the pre-nip N1 is the pressure generated by the resiliency of the pressure belt 2 as the pressure belt 2 is made to contact with the peripheral surface of the fixation roller 1 against the rigidity (stiffness) of the pressure belt 2. That is, the internal pressure of the pre-nip N1 is such a pressure that is generated by the resiliency (rigidity and flexibility of substrate layer 2*a*) of the pressure belt 2 itself as force is applied to the pressure belt 2 to make the pressure belt 2 contact the peripheral surface of the fixation roller 1. Therefore, the pressure nip N2 is formed by placing the portion of the pressure belt 2, which is backed up by the pressure pad 4, in contact with the peripheral surface of the fixation roller 1. In comparison, the pre-nip N1 is formed by placing the portion of the pressure belt 2, which is not backed up by the pressure pad 4, in contact with the peripheral surface of the fixation roller 1, only by the resiliency of the pressure belt 2. In this embodiment (first preferred embodiment), the width of the pre-nip N1 is set to roughly 9 mm, and the width of the pressure nip N2 is set to roughly 7 mm.

The pre-nip N1 described above is formed by the contact between the flexible and deformable pressure belt 2, and the cylindrical fixation roller 1. Therefore, the internal pressure of the pre-nip N1 is very low, and the pressure of the pre-nip N1 is roughly uniform. Thus, the pre-nip N1 remains stable in terms of the state of contact between the pressure belt 2 and the peripheral surface of the fixation roller 1. Further, the pre-nip N1 is formed so that it is continuous with "pressure nip N2 which is formed by placing the portion of the pressure belt 2, which is backup by the pressure pad 4, in contact with the peripheral surface of the fixation roller 1". Therefore, while the recording medium P is conveyed, remaining pinched by the pressure belt 2 and fixation roller 1, through the fixation nip N, the airtight contact between the recording medium P and fixation roller 1, and the airtight contact between the recording medium P and pressure belt 2, are maintained throughout the entirety of the fixation nip N, that is, the combination of the pre-nip N1 and pressure nip N2. Therefore, the internal pressure of the fixation nip N gradually increases from the nip entrance toward the point at which the internal pressure becomes highest, without decreasing between the nip entrance and the point with the highest pressure. That is, the fixation nip N begins at the pre-nip N1, and continues to the exit end of the pressure nip N2, in terms of the recording medium conveyance direction C. The fixation nip N is the nip which was formed by placing the peripheral surface of the fixation roller 1 and the outward surface of the pressure belt 2 in contact with each other by the pressure pad 4.

As described above, the fixation nip N where the fixation roller 1 and pressure belt 2 remain in contact with each other has: the pre-nip (first nip) N1 which does not have the backup from the pressure pad 4, and in which the pressure belt 2 is kept in contact with the fixation roller 1 by the resiliency of the pressure belt 2; and the pressure nip (second nip) N2 in which the pressure belt 2 remains in contact with the fixation roller 1 by being back up by the pressure pad 4. Further, in terms of the recording medium conveyance direction C, the fixation nip N begins from the first nip N1. Further, the first nip N1 and second nip N2 are continuous.

(1-2-5) Description of Thermal Fixing Operation of Fixing Apparatus

As the driving gear (unshown) attached to one of the lengthwise ends of the metallic core 1*a* of the fixation roller 1 is rotationally driven by a motor (unshown), the fixation roller 1 is rotated in the direction indicated by an arrow mark A at a preset peripheral velocity (FIG. 1). As the fixation roller 1 rotates, the rotation of the fixation roller 1 is transmitted to the pressure belt 2 in the pressure nip N2. Thus, the pressure belt 2 follows the rotation of the fixation roller 1, rotating thereby in the direction indicated by an arrow mark B. The substrate layer 2*a* of pressure belt 2 in this embodiment (first preferred embodiment) possesses both rigidity (stiffness) and flexibility. Therefore, the pressure belt 2 rotates while remaining in contact with the peripheral surface of the fixation roller 1, and therefore, forming the pre-nip N1 between the pressure belt 2 and the peripheral surface of the fixation roller 1.

To the heater 5, electric power begins to be supplied by an electric power controlling portion 120 (as an electric power controlling means) (FIG. 1), slightly before or after, or at the same time as, the starting of the rotation of the fixation roller 1. Thus, the heater 5 begins to generate heat, heating thereby the rotating fixation roller 1. Then, the heat obtained by the fixation roller 1 transmits to the rotating pressure belt 2 through the pressure nip N2 and pre-nip N1, heating thereby the pressure belt 2. The temperature of the fixation roller 1 is detected by a temperature detection element 6 (as a temperature detecting member) (FIG. 1) on the peripheral surface side of the fixation roller 1, and the electric power controlling portion 120 controls the temperature of the heater 5 by controlling the electric power to the heater 5, based on the output signals from the temperature detection element 6. That is, the electric power controlling portion 120 controls the electric power supply to the heater 5, based on the output signals from the temperature detection element 6, so that the temperature of the peripheral surface of the fixation roller 1 remains at the preset level (target level), which is 180° C.

While the fixation roller 1 and pressure belt 2 are rotated, and electric power is supplied to the heater 5 as described above, a recording medium P, which has a toner image T on its surface, is conveyed through the pre-nip N1, being positioned so that its surface having the toner image T faces upward.

The recording medium P is conveyed through the pre-nip N1, while remaining weakly and evenly pinched between the fixation roller 1 and pressure belt 2 throughout the pre-nip N1, by the fixation roller 1 and the resiliency of pressure belt 2.

While the recording medium P is conveyed through the pre-nip N1, it is preheated from both the toner image bearing surface side, that is, the fixation roller side, and the side having no toner image, that is, the pressure belt side, by the pre-heated fixation roller 1 and pressure belt 2, respectively. Referring to FIG. 3, the pre-nip N1 is formed by the simple contact between the fixation roller 1 and pressure belt 2, being therefore advantageous in that the heat which the fixation roller 1 and pressure belt 2 have can be efficiently transmitted to the recording medium P.

In the pre-nip N1, the recording medium P remains pinched between the peripheral surface of the fixation roller 1 and outward surface of the pressure belt 2 by the fixation roller 1 and the "resiliency of the pressure belt 2" as described above. Therefore, the top and bottom surfaces of the recording medium P are uniformly pressed by a very weak pressure, and preheated across their entireties.

The toner image T on the recording medium P is sufficiently heated for the toner image T to reach the preset fixation temperature level, in the pre-nip N1 which is continuous to the pressure nip N2. In the pressure nip N1, the toner image T on the recording medium P is conveyed while remaining under the pressure from the peripheral surface of the fixation roller 1 and the outward surface of the fixation roller 1. Thus, the toner image T on the recording medium P is thermally fixed to the surface of the recording medium P so that the toner image T remains satisfactorily fixed to the recording medium P, and also, that the toner image T has a proper amount of glossiness. That is, the fixing apparatus 112 is set up so that the time for sufficiently melting the toner image T while hardly applying pressure to the toner image T in the pre-nip N1 can be secured, and then, the toner image T can be heated and pressed in the pressure nip N2 to fix the toner image T to the recording medium P. The temperature distribution and pressure distribution, which can achieve the above-described object, can be obtained by the combination of the pre-nip N1 and pressure nip N2. Therefore, the occurrence of the failure of the fixation of the toner image T, blisters, offsets, and the like, can be greatly reduced.

Then, the recording medium P is discharged from the pressure nip N2.

(1-2-6) Description of Recording Medium Passage Through Pre-Nip and Pressure Nip FIG. 4 is a sectional drawing of the fixation roller 1, pressure belt 2, and pressure pad 4 of the fixing apparatus 112, in the first preferred embodiment of the present invention, while a sheet of thin recording paper (ordinary paper with basic weight of 75 g/cm$^2$, for example) is conveyed through the fixation nip N of the fixing apparatus 112. FIG. 5 is a sectional drawing of the fixation roller 1, pressure belt 2, and pressure pad 4 of the fixing apparatus 112, in the first preferred embodiment of the present invention, while a sheet of thick recording paper (ordinary paper with basic weight of 220 g/cm$^2$, for example) is conveyed through the fixation nip N of the fixing apparatus 112.

As a thin recording medium P is introduced into the fixation nip N, the pressure pad 4 rotationally moves about the pressure pad shaft 3, which is on the exit side of the pressure nip N2, in terms of the recording medium conveyance direction C, in such a manner that the entrance side 4*a* of the pressure pad 4 rotationally moves downward by a preset amount (FIG. 4). That is, when a thin recording medium P, on which the toner image T is present, is conveyed through the fixation nip N, the leading edge of the thin recording medium P, in terms of the recording medium conveyance direction C, is pinched between the fixation roller 1 and pressure belt 2 at the entrance of the pre-nip N1. Then, the thin recording medium P is conveyed through the pre-nip N1 toward the pressure nip N2 by the rotation of the fixation roller 1 and pressure belt 2 while remaining pinched between the fixation roller 1 and pressure belt 2. While the thin recording medium P is conveyed, it pushes the pressure belt 2, moving thereby the pressure belt 2 toward the outward surface side of the pressure pad 4 by the amount proportional to the thickness of the recording medium P. The inward surface of the pressure belt 2 and the surface of the pressure pad 4 are not in contact with each other in the pre-nip N1, and the surface of the pressure pad 4 has curvature. Therefore, as the leading edge of the thin recording medium P approaches the pressure nip N2, the amount by which the pressure belt 2 is moved toward the surface side of the pressure pad 4 gradually increases, causing eventually the inward surface of the pressure belt 2 to come into contact with the surface of the pressure pad 4. As the inward surface of the pressure belt 2 comes into contact with the surface of the pressure pad 4, the pressure belt 2 rotationally moves the pressure pad 4 against the pressure P2 from the springs 8, so that the entrance side 4*a* of the pressure pad 4, in terms of the recording medium conveyance direction C, moves downward by the amount which is proportional to the amount by which the pressure belt 2 is pushed out. Thus, it is only when the thin recording medium P is conveyed through the fixation nip N while remaining pinched between the fixation roller 1 and pressure pad 4 that the pressure pad 4 is rotationally moved by the recording medium P about the pressure pad shaft 3, in such a manner that the entrance side 4*a* of the pressure pad 4, in terms of the recording medium conveyance direction C, moves downward. Therefore, in the case of the thin recording medium P, the width of the pre-nip N1 of the fixation nip N, and the width of the pressure nip N2 of the fixation nip N, remain the same whether or not the recording medium P is conveyed through (introduced into) the fixation nip N.

On the other hand, as a thick recording medium P is conveyed through the fixation nip N as shown in FIG. 5, the entrance side 4*a* of the pressure pad 4 in terms of the recording medium conveyance direction C moves downward by a substantially large amount than when the thin recording medium P is conveyed, because of the difference in thickness between the thick and thin recording mediums P. That is, as the thick recording medium P, on which the toner image T is present, is conveyed through the fixation nip N, the leading edge of the thick recording medium P, in terms of the recording medium conveyance direction C, is pinched by the fixation roller 1 and pressure belt 2 at the entrance side 4*a* of the pre-nip N1. Then, the thick recording medium P is conveyed through the pre-nip N1 toward the pressure nip N2 by the rotation of the fixation roller 1 and pressure belt 2 while remaining pinched by the fixation roller 1 and pressure belt 2. While the thick recording medium P is conveyed, it pushes the pressure belt 2, moving thereby the pressure belt 2 toward the outward surface side of the pressure pad 4 by the amount proportional to the thickness of the thick recording medium P. The inward surface of the pressure belt 2 and the surface of the pressure pad 4 are not in contact with each other in the pre-nip N1, and the surface of the pressure pad 4 has curvature. Therefore, as the leading edge of the thick recording medium P approaches the pressure nip N2, the amount by which the pressure belt 2 is moved toward the surface side of the pressure pad 4 gradually increases, causing eventually the inward surface of the pressure belt 2 to come into contact with the surface of the pressure pad 4. As the inward surface of the pressure belt 2 comes into contact with the surface of the pressure pad 4, the pressure belt 2 rotationally moves the pressure pad 4 against the pressure P2 from the springs 8, about the pressure pad shaft 3, so that the entrance side 4*a* of the pressure pad 4, in terms of the recording medium conveyance direction C, moves downward by the amount which is proportional to the amount by which the pressure belt 2 is pushed out. Thus, it is only when the thick recording medium P is conveyed through the fixation nip N while remaining pinched between the fixation roller 1 and pressure pad 4 that the pressure pad 4 is rotationally moved by the recording medium P about the pressure pad shaft 3, in such a manner that the entrance side 4*a* of the pressure pad 4, in terms of the recording medium conveyance direction C, moves downward. Therefore, even in the case where the thick recording medium P is conveyed, the increases which are caused to the internal pressure of the fixation nip N and the pressure nip width by the recording medium P when the recording medium P is conveyed, is not as much as those caused when it is conveyed through a conventional fixing apparatus. Thus, even when the thick recording medium P is conveyed, the width of the pre-nip N1 of the fixation nip N, and the width of the pressure nip N2 of the fixation nip N, remains roughly the same as when the thin recording medium P is conveyed.

(1-2-7) Description of Pressure Distribution of Fixation Nip

Figure 6:
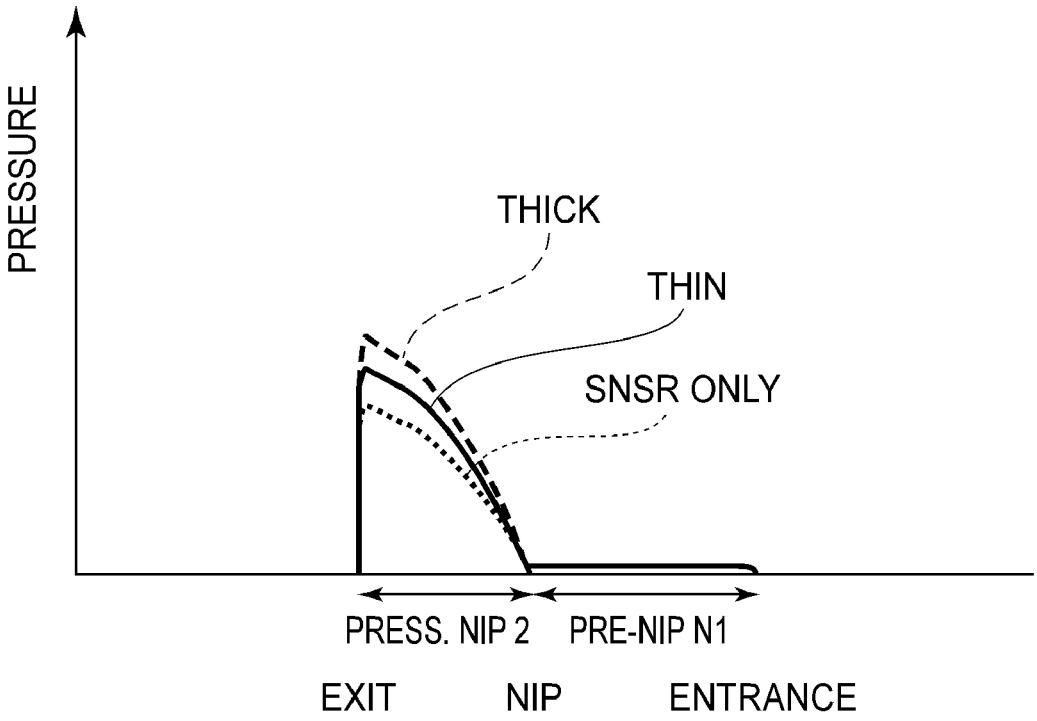
FIG. 6 is a graphical drawing which shows the pressure distribution of the fixation nip of the fixing apparatus in the first preferred embodiment of the present invention.

FIG. 6 is a graphic drawing which shows the pressure distribution of the fixation nip N of the fixing apparatus 112 in the first preferred embodiment of the present invention.

The pressure distribution of the fixation nip N was measured with the use of a pressure distribution measuring system PINCH (product of Nitta Co., Ltd.). FIG. 6 shows three pressure distributions of the fixation nip N, which are different in the objects in the fixation nip N; the pressure distribution when only a pressure sensor is in the fixation nip N, pressure distribution when a combination of the pressure sensor and a sheet of thin recording medium (ordinary paper which is 75 g/m$^2$ in basic weight), is in the fixation nip N, and pressure distribution when a combination of the pressure sensor and a sheet of thick recording medium (220 g/m$^2$ in basic weight) is in the fixation nip N, are compared.

One of the characteristic features of the fixing apparatus 112 in the first preferred embodiment is that the internal pressure of the pre-nip N1 is very low compared to the pressure peak in the pressure nip N2, which is generated by pressing the fixation roller 1 and pressure pad 4 relative to each other. The reason why the internal pressure in the pre-nip N1 is lower than the internal pressure in the pressure nip N2 is that in the pre-nip N1, the pressure belt 2 is kept in contact with the fixation roller 1 only by the resiliency of the pressure belt 2. That is, the fixing apparatus 112 is structured so that while a sheet of recording medium P is conveyed through the fixation nip N, the pressure to which the sheet of recording medium P is subjected does not reduce.

Compared to the internal pressure of the fixation nip N when only the pressure sensor is in the fixation nip N, the internal pressure of the fixation nip N when a sheet of thin recording medium P is in the fixation nip N is higher because of the presence of the thin recording medium P. As a thin recording medium P is conveyed through the fixation nip N, the pressure pad 4 is adjusted in position in such a manner that its entrance side 4*a* in terms of the recording medium conveyance direction C rotationally is moved downward by the preset amount. Therefore, the width of the pre-nip N1 of the fixation nip N, and the width of the pressure nip N2 of the fixation nip N become approximately the same. Thus, the width of the pre-nip N1 of the fixation nip N, and the pressure nip N2 of the fixation nip N, are kept approximately constant whether the recording medium is conveyed through the fixation nip N or not.

Further, compared to the pressure distribution of the fixation nip N when a thin recording medium P is in the fixation nip N, the pressure of the fixation nip N when a thick recording medium P is in the fixation nip N is higher because of the difference in thickness between the thick and thin recording mediums P. Further, even when a thick recording medium P is conveyed through the fixation nip N, the pressure pad 4 is adjusted in position in such a manner that its entrance side 4*a* in terms of the recording medium conveyance direction C rotationally moves downward by the preset amount. Therefore, the width of the pre-nip N1 of the fixation nip N, and the width of the pressure nip N2 of the fixation nip N, become roughly the same as those when the thin recording medium P is conveyed.

Embodiment 2

Next, another example of a fixing apparatus 112 in accordance with the present invention will be described.

In the description of the second preferred embodiment of the present invention, the members, portions, and the like, of the fixing apparatus 112, which are the same as those in the first preferred embodiment, are given the same referential codes as those given in the description of the first preferred embodiment, and they will not be described here, and so will be the comparable members, portions, and the like, in the third preferred embodiment of the present invention.

Figure 7:
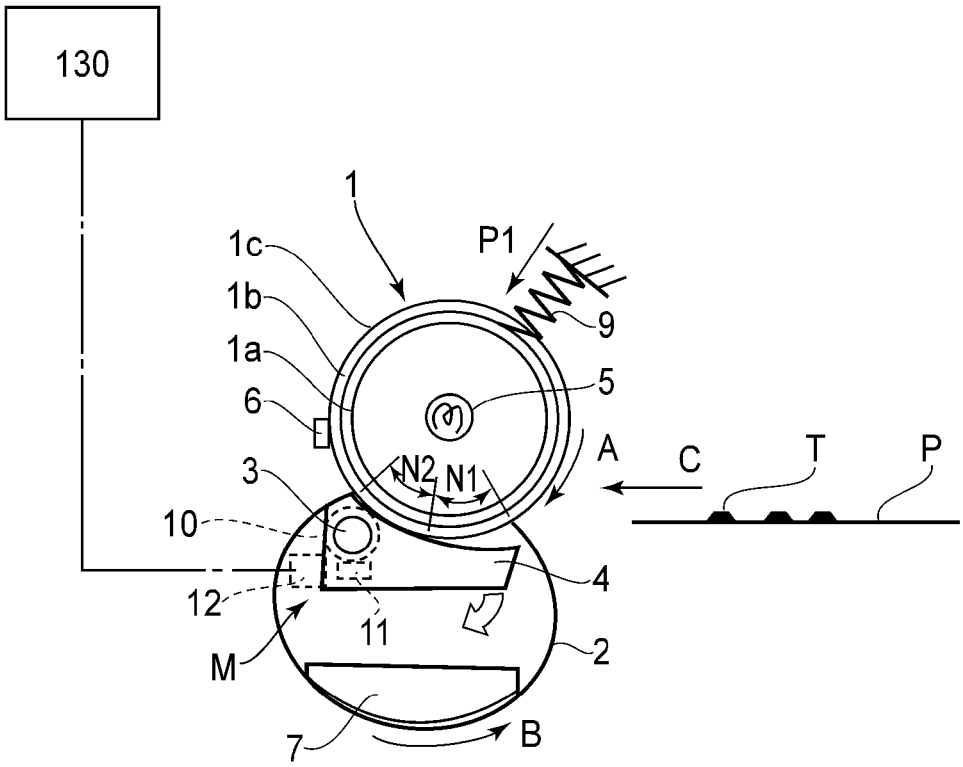
FIG. 7 is a sectional drawing of a fixing apparatus in the second preferred embodiment of the present invention.

FIG. 7 is a schematic cross-sectional drawing of the fixing apparatus 112 in the second preferred embodiment.

The fixing apparatus 112 in this embodiment is basically the same in structure, except that instead of having the above described springs 8, the fixing apparatus 112 in this embodiment has a driving mechanism M (driving means) for rotationally moving the pressure pad 4 according to the type and basic weight of the recording medium P conveyed through the fixation nip N while remaining pinched between the fixation roller 1 and pressure belt 2.

In the case of the fixing apparatus 112 in this embodiment, therefore, the width of the pre-nip N1 of the fixation nip N, and the width of the pressure nip N2 of the fixation nip N, are kept approximately constant regardless of the type and basic weight of the recording medium P.

(2-1) Description of Driving Mechanism

The driving mechanism M has a gear 10 (gear to be driven), a driving gear 11, and a pressure pad motor (driving force source). The gear 10 is attached to one of the lengthwise ends of the pressure pad shaft 3. This gear 10 meshes with the driving gear 11 attached to the output shaft of the pressure pad motor 12. The pressure pad motor 12 is solidly attached to the apparatus frame. The pressure pad motor 12 is controlled by a MPU (microprocessor unit 130) as a controlling means for controlling the entirety of the image forming apparatus 100.

The MPU 130 obtains the type of recording medium P conveyed through the fixation nip N, from the information regarding the recording medium selection inputted by a user through a control panel of the image forming apparatus 100, information regarding the recording medium selection by a media center, external input from a personal computer or the like. The MPU 130 determines, based on the obtained information regarding the recording medium P, the basic weight of the recording medium P, with reference to a preset table or the like. Then, the MPU 130 makes the image forming apparatus 100 operate in the proper mode for the recording medium P. For example, in a case where the MPU 130 determines that the recording medium P to be used is ordinary paper which is 75 g/cm$^2$ in basic weight, it places the pressure pad 4 in the normal mode position, based on the basic weight table for ordinary paper. In a case where the MPU 130 determines that ordinary paper which is 220 g/m$^2$ in basic weight is going to be used, it places the pressure pad 4 in the thick paper mode position. In this embodiment (second preferred embodiment), in a case where ordinary paper or coated paper is used as the recording medium P, the normal mode is selected when the recording medium P is no more than 150 g/m$^2$ in basic weight, whereas in a case where the recording medium P is no less than 150 g/m$^2$ in basic weight, the thick medium mode is selected.

Figure 8:
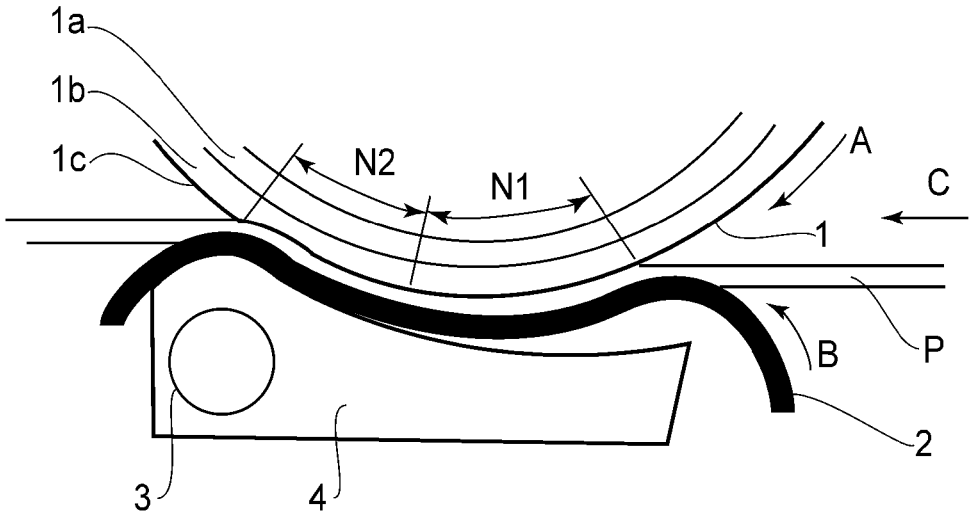
FIG. 8 is a sectional drawing of a fixation nip of the fixing apparatus, in the second preferred embodiment of the present invention, while a sheet of thin recording paper is conveyed through the fixation nip when the fixing apparatus is in the normal mode.
Figure 9:
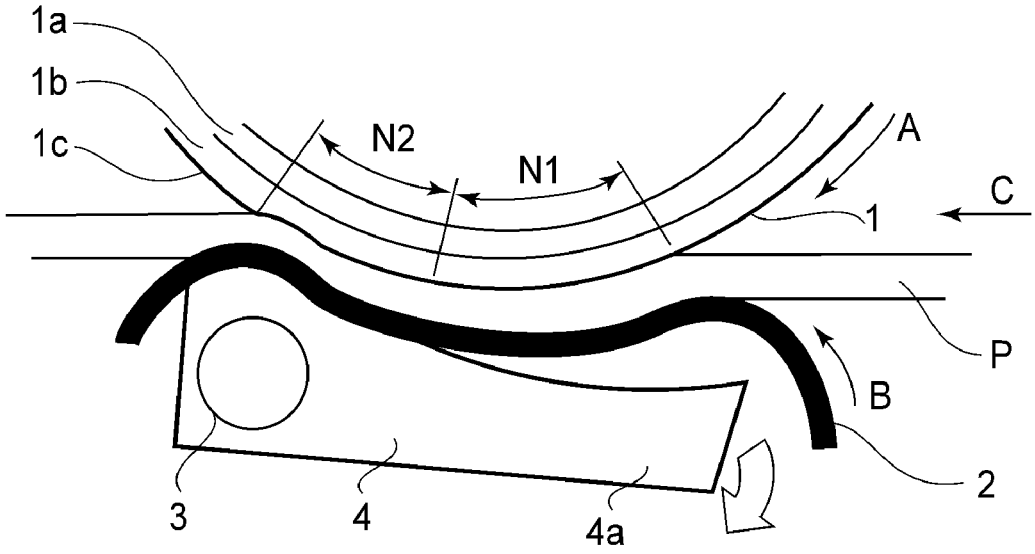
FIG. 9 is a sectional drawing of a fixation nip of the fixing apparatus, in the second preferred embodiment of the present invention, while a sheet of thick recording paper is conveyed through the fixation nip when the fixing apparatus is in the thick paper mode.

FIG. 8 is a sectional drawing of the fixation roller 1, pressure belt 2, and pressure pad 4 when a sheet of thin recording medium P (ordinary paper which is 75 g/m$^2$ in basic weight, for example) is being conveyed through the fixation nip N while the fixing apparatus 112 is in the normal mode. FIG. 9 is a sectional drawing of the fixation roller 1, pressure belt 2, and pressure pad 4 when a sheet of thick recording medium P (ordinary paper which is 220 g/m$^2$ in basic weight, for example) is being conveyed through the fixation nip N while the fixing apparatus 112 is in the thick recording medium mode.

In the case of the fixing apparatus 112 in this embodiment (second preferred embodiment), its home position is the position in which the pressure pad 4 is while the MPU 130 is carrying out the normal mode (FIG. 8). When the MPU 130 carries out the thick paper mode, it rotates the output shaft of the pressure pad motor 12 by a preset amount by driving the pressure pad motor 12, and then, stops rotating the pressure pad motor 12. The rotation of the output shaft of the pressure pad motor 12 is transmitted to the pressure pad shaft 3 through the driving gear 11 and the gear 10 (gear to be driven). Thus, the pressure pad 4 is rotationally moved by the rotation of the pressure pad shaft 3 in such a manner that its entrance side 4*a* of the pressure pad 4 in terms of the recording medium conveyance direction C rotationally moves roughly 4° downward from where the entrance side 4*a* is when the pressure pad 4 is in its home position. With this movement of the entrance side 4*a* of the pressure pad 4, the width of the pre-nip N1 of the fixation nip N, and the width of the pressure nip N2 of the fixation nip N, become approximately the same as they are when a sheet of thin recording medium P is remaining pinched in the fixation nip N. In other words, the width of the pre-nip N1 of the fixation nip N, and the width of the pressure nip N2 of the fixation nip N, are kept approximately the same and constant regardless of the thickness of the recording medium P.

Also in the case of the fixing apparatus 112 in the second preferred embodiment, the pressure distribution of the fixation nip N was measured with the use of the pressure distribution measuring system PINCH (product of Nitta Co., Ltd.).

The pressure distribution of the fixation nip N in this embodiment which was measured in the normal mode when the pressure sensor and a sheet of thin recording medium P (ordinary paper which is 75 g/cm$^2$, for example, in basic weight) were remaining pinched in the fixation nip N is the same as that when the pressure sensor and a sheet of thin recording medium P (ordinary paper which is 75 g/cm$^2$, for example, in basic weight) were remaining pinched in the fixation nip N of the fixing apparatus 112 in the first preferred embodiment (FIG. 6). Further, the pressure distribution of the fixation nip N in this embodiment which was measured in the thick recording medium mode when the pressure sensor and a sheet of thick recording medium P (ordinary paper which is 220 g/cm$^2$, for example, in basic weight) were remaining pinched in the fixation nip N was the same as that when the pressure sensor and a sheet of thick recording medium P were remaining pinched in the fixation nip N of the fixing apparatus 112 in the first preferred embodiment (FIG. 6).

Embodiment 3

Next, another (third) preferred embodiment of the present invention will be described.

The fixing apparatus 112 in this embodiment is a fixing apparatus 112 which uses an electromagnetic heating method.

Figure 10:
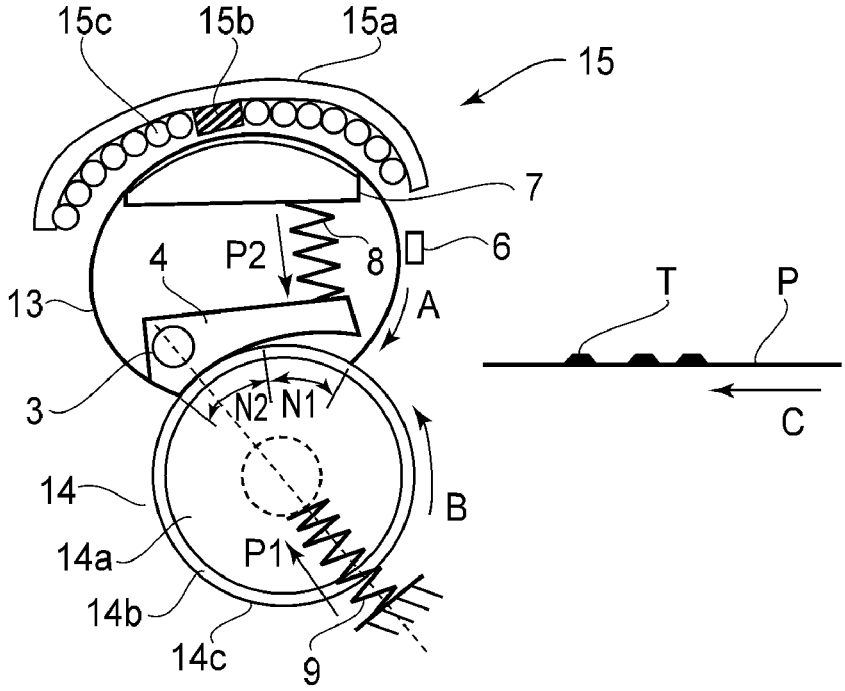
FIG. 10 is a sectional drawing of a fixing apparatus in the third preferred embodiment of the present invention.
Figure 11:
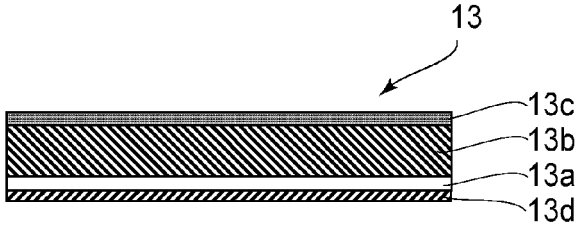
FIG. 11 is a sectional drawing of a pressure belt of the fixing apparatus in the third preferred embodiment of the present invention, and shows the laminar structure of the pressure belt.

FIG. 10 is a schematic cross-sectional drawing of the fixing apparatus 112 in the third preferred embodiment of the present invention. FIG. 11 is a sectional drawing of the fixation belt 13 of the fixing apparatus 112 in the third preferred embodiment of the present invention, and shows the laminar structure of the fixation pressure belt 13.

The fixing apparatus 112 in this embodiment has: the fixation belt 13 which is an endless belt; a pressure roller 14; a pressure pad 4 as a pressure applying member; a magnetic flux generating means (coil unit) 15 as a heating means (heating member); and a belt guide 7. The fixation belt 13, pressure roller 14, coil unit 15, pressure pad 4, and belt guide 7 are all long and narrow members, the lengthwise direction of which is parallel to the abovementioned lengthwise direction of the fixing apparatus 112.

(3-1) Description of Fixation Belt

The fixation belt 13 has: a metallic layer 13*a* (substrate layer), as a heat generating layer based on electromagnetic induction, which is in the form of an endless belt and is formed of a magnetic metallic substance; an elastic layer 13*b* layered on the outward surface of the metallic layer 13, and is formed of such a substance as silicone rubber; and a separation layer 13*c* layered on the outward surface of the elastic layer 13*b*. The external diameter of the fixation belt 13 is 45 mm. It is loosely fitted around the combination of the pressure pad 4 and belt guide 7. The metallic layer 13*a* itself has a proper amount of rigidity (stiffness).

The metallic layer 13*a* is in the form of an endless belt, and is 50 μm in thickness. It is formed of a substance, such as nickel, which is excellent in electrical conductivity. It generates heat, based on eddy current loss attributable to the magnetic flux generated by an induction coil 15*c* of the magnetic flux generating means 15, which will be described later. In order to obtain an excellent fixed image when fixing an unfixed color image, the elastic layer 13*b* is formed of silicone rubber, and is made to be 300 μm in thickness. The separation layer 13*c* is roughly 10-50 μm in thickness, and is formed of a fluorinated resin, such as PFA, PTFE (polytetrafluoroethylene). It is made in the form of a piece of tube which wraps around the fixation belt 13, or coated on the outward surface of the elastic layer 13*b*.

In the third preferred embodiment, the fixation belt 13 is provided with a layer 13*d*, which is on the inward surface of the metallic layer 13*a*, which is in contact with the surface of the pressure pad 4 and the surface of the belt guide 7. The layer 13*d* is for making it easier for the fixation belt 13 to slide on the surface of the pressure pad 4 and the surface of the belt guide 7. The layer 13 is formed by coating the inward surface of the metallic layer 13*a* with a highly heat resistant resin, such as polyimide, polyamide, polyimide-amide, and the like. The external diameter of the fixation belt 13 is 45 mm.

The length of the fixation belt 13 is approximately the same as that of the pressure roller 14.

(3-2) Description of Magnetic Flux Generating Means

The magnetic flux generating means 15 has a casing 15*a* for its inductive heating means, a magnetic core 15*b* (which hereafter will be referred to simply as core 15*b*), and the induction coil 15*c* for heating (which hereafter will be referred to simply as coil). The core 15*b* is formed of a single or multiple layers of ferrite, for example. The length of the core 15*b* is roughly the same as that of the fixation belt 13. The coil 15*c* is formed of a piece of copper wire, the surface of which is covered with a self-welding insulative substance. It is convolutely wound multiple times in the form of a narrow and flat sheet of thick paper. It is disposed in parallel to the core 15*b*, covering the core 15*b*.

The casing 15*a* for the inductive heating means 15 is formed of a dielectric resin. It is a long, narrow, and thin box, in which the coil 15*c* and core 15*b* are stored. The core 15*b* is disposed in the casing 15*a* in such a manner that the magnetic flux does not leak through the portions of the casing 15*a*, which do not face the outward surface of the fixation belt 13. The casing 15*a* is in such a shape that its cross section at a plane parallel to the moving direction of the fixation belt 13 is arcuate. The casing 15*a* is disposed close to the outward surface of the fixation belt 13, with the presence of a preset amount of distance between the casing 15*a* and outward surface of the fixation belt 13. The casing 15*a* is held to the apparatus frame, by its lengthwise ends.

(3-3) Description of Pressure Roller

The pressure roller 14 is an elastic roller. It has: a metallic core 14*a* which is formed of SUS (stainless steel) and is 30 mm in diameter; a 5 mm thick elastic layer 14*b* formed of silicone rubber, on the peripheral surface of the metallic core 14*a*; and a 10-50 μm thick separation layer 14*c* formed of fluorinated resin, on the peripheral surface of the elastic layer 14*b*. The fluorinated material for the separation layer 14*c* is PFA, PTFE, or the like. The external diameter of the pressure roller 14 is 40 mm.

(3-4) Description of Pressure Pad and Belt Guide

The pressure pad 4 is approximately the same in length as the fixation belt 13, and is disposed so that it applies pressure to the pressure roller 14, with the presence of fixation belt 13 between the pressure pad 4 and pressure roller 14. The pressure pad 4 has a pressure pad shaft 3 (rotational axis), which is on the exit side in terms of recording medium conveyance direction C (downstream side in terms of recording medium conveyance direction C). The fixing apparatus 112 is structured so that the pressure pad 4 is allowed to rotate about the pressure pad shaft 3. The pressure pad 4 is made roughly the same in length as the fixation belt 13, and is disposed so that it applies pressure to the pressure roller 14, with presence of the fixation belt 13 between the pressure pad 4 and pressure roller 14. The pressure pad 4 has the pressure pad shaft 3 (rotational axis), which is in the exit side of the pressure pad 4 in terms of the recording medium conveyance direction C (downstream side in terms of recording medium conveyance direction C). The pressure pad 4 is rotationally movable about the pressure pad shaft 3.

The surface layer of the pressure pad 4, which is in contact with the inward surface of the fixation belt 13, is formed of a fluorinated resin, such as PFA, PTFE (polytetrafluoroethylene), and the like, and is roughly 10-50 μm in thickness. The presence of this fluorinated layer reduces the frictional resistance between the surface of the pressure pad 4 and the inward surface of the fixation belt 13. Further, in order to reduce the frictional resistance between the surface of the pressure pad 4 and the inward surface of the fixation belt 13, the inward surface of the fixation belt 13 may be coated with a heat resistance lubricant such as fluorinated grease.

The pressure pad 4 is structured so that its surface which faces the fixation belt 13 is provided with such an inward curvature that matches the curvature of the peripheral surface of the fixation belt 13. More concretely, the radius of curvature of the curved surface of the pressure pad 4 is 35 mm, being larger than the radius (20 mm) of the peripheral surface of the fixation roller 1.

The belt guide 7 is disposed above the pressure pad 4, and opposes the pressure pad 4. The surface of the belt guide 7, which is in contact with the fixation belt 13, is provided with such a curvature that matches the curvature of the inward surface of the fixation belt 13.

The entrance end of the pressure pad 4 in terms of the recording medium conveyance direction C (upstream end in terms of recording medium conveyance direction) is kept weakly pressed in the direction indicated by an arrow mark P2 (direction perpendicular to recording medium conveyance direction C) in FIG. 10, by springs 8 located between the pressure pad 4 and belt guide 7. This setup allows the entrance side 4*a* of the pressure pad 4, in terms of the recording medium conveyance direction C, to rotationally move about the pressure pad shaft 3, by a distance which is proportional to the thickness of the recording medium P, as the recording medium P is conveyed through (introduced into) the fixation nip N, which will be described later. Further, there are springs 9 between the bearings of the pressure roller 14 and the apparatus frame, and the pressure roller 14 is kept strongly pressed against the pressure pad shaft 3 by the springs 9 in the direction indicated by an arrow mark P1 in FIG. 10 (direction perpendicular to rotational axis of pressure roller 14 and rotational axis of pressure pad shaft 3). In this embodiment (third preferred embodiment), the amount of the pressure applied in the direction indicated by the arrow mark P1 was set to roughly 392 N (40 kgf), and the amount of the pressure applied in the direction indicated by the arrow mark P2 was set to roughly 49 N (5 kgf).

(3-5) Description of Pressure Nip and Pre-Nip

Referring to FIG. 10, the pressure pad 4 is pressed in the direction of the arrow mark P2, and the pressure roller 14 is pressed in the direction of the arrow mark P1. Thus, the pressure nip N2 is formed by the contact between the pressure belt 13 and pressure roller 14. Therefore, the fixation belt 13 contacts the peripheral surface of the pressure roller 14 from the entrance side of the pressure nip N2, in terms of the recording medium conveyance direction C, across a preset range. With the provision of this structural arrangement, the fixation belt 13 deforms by a proper amount while remaining in balance in terms of the circumference direction of the pressure roller 14. Thus, the pre-nip N1 is formed across the area of the fixation belt 13, which contacts the peripheral surface of the pressure roller 14. Therefore, the nip pressure in the pre-nip N1 is the pressure generated by the resiliency of the fixation belt 13 as the fixation belt 13 is made to contact with the peripheral surface of the pressure roller 14 against the rigidity (stiffness) of the fixation belt 13. That is, the internal pressure in the pre-nip N1 is such a pressure that is generated by the resiliency (rigidity and flexibility of metallic layer 13*b*) of the fixation belt 13 itself as force (pressure) is applied to the fixation belt 13 to make the fixation belt 13 contact the peripheral surface of the pressure roller 14. The pressure nip N2 is formed by placing the portion of the fixation belt 13, which is backed up by the pressure pad 4, in contact with the peripheral surface of the pressure roller 14. In comparison, the pre-nip N1 is formed by placing the portion of the fixation belt 13, which is not backed up by the pressure pad 4, in contact with the peripheral surface of the pressure roller 14, only by the resiliency of the fixation belt 13.

The pre-nip N1 described above is formed by the contact between the flexible and deformable fixation belt 13, and the cylindrical pressure roller 14. Therefore, pressure in the pre-nip N is roughly uniform. Thus, the pre-nip N1 remains stable in terms of the state of contact between the fixation belt 13 and the peripheral surface of the pressure roller 14. Further, the pre-nip N1 is formed so that it is continuous with the pressure nip N2 which is formed by placing the portion of the fixation belt 13, which is backup by the pressure pad 4, in contact with the peripheral surface of the pressure roller 14. Therefore, while the recording medium P is conveyed, remaining pinched by the fixation belt 13 and pressure roller 14, through the fixation nip N, the airtight contact between the recording medium P and pressure roller 14, and the airtight contact between the recording medium P and fixation belt 13, are maintained through the entirety of the fixation nip N. That is, the fixation nip N begins at the pre-nip N1, and continues to the exit end of the pressure nip N2, in terms of the recording medium conveyance direction C.

(3-6) Description of Thermal Fixing Operation of Fixing Apparatus

As the driving gear (unshown) attached to one of the lengthwise ends of the metallic core 14*a* of the pressure roller 14 is rotationally driven by a fixation motor (unshown), the pressure roller 14 is rotated in the direction indicated by an arrow mark B at a preset peripheral velocity (FIG. 10). As the pressure roller 14 rotates, the rotation of the pressure roller 14 is transmitted to the fixation belt 13, in the pressure nip N2. Thus, the fixation belt 13 follows the rotation of the pressure roller 14, rotating in the direction indicated by an arrow mark A. The metallic layer 13*a* of fixation belt 13 in this embodiment (third preferred embodiment) possesses both rigidity (stiffness) and flexibility. Therefore, the fixation belt 13 rotates while remaining in contact with the peripheral surface of the pressure roller 14, and therefore, forming the pre-nip N1 between the fixation belt 13 and the peripheral surface of the pressure roller 14.

To the coil 15*c*, an alternating electric current, which is 10 K-1 MHz in frequency, begins to flow from an unshown exciter circuit which is under the control of an electric power controlling portion 120, slightly before or after, or at the same time as, the starting of the rotation of the pressure roller 14. Thus, the metallic layer 13*a* of the metallic fixation belt 13 is heated by magnetic induction. As electric current flows through the coil 15*c*, the magnetic flux, which is to be supplied to the fixation belt 13, is generated. This magnetic flux is absorbed by the metallic layer 13*a* of the fixation belt 13, in the area where the casing 15*a* for the inductive heating means opposes the fixation belt 13. Thus, the metallic layer 13*a* generates heat because its specific resistance. The heat generated in the metallic layer 13*a* transmits to the surface of the fixation belt 13, and also, transmits inward of the fixation belt 13. Then, the heat transmits from the fixation belt 13 through the pressure nip N2 and pre-nip N1 to the pressure roller 14, which is rotating. Thus, the pressure roller 14 is heated. The temperature of the fixation belt 13 is detected by a temperature detection element 6 (FIG. 10), which is on the outward side of the fixation belt 13. The temperature of the fixation belt 13 is controlled by an electric power controlling portion 120 (see FIG. 1) which controls the exciter circuit, based on the output signals from the temperature detection element 6. That is, the electric power controlling portion 120 controls the amount by which alternating current flows from the exciter circuit, based on the output signals, so that the surface temperature of the fixation belt 13 remains at a preset fixation temperature level (target temperature level), which is 180° C.

While the fixation belt 13 and pressure roller 14 are rotated, and electric current flows through the coil 15*c* as described above, the recording medium P, on which the toner image T is present, is conveyed through the pre-nip N1, being positioned so that its surface having the toner image T faces upward.

The recording medium P is conveyed through the pre-nip N1 while remaining gently pinched between the fixation belt 13 and pressure roller 14 by the resiliency of the fixation belt 13.

While the recording medium P is conveyed through the pre-nip N1, it is preheated from both the toner image bearing surface side, that is, the fixation roller side, and the side having no toner image, that is, the pressure belt side, by the pre-heated pressure roller 14 and fixation belt 13, respectively. Referring to FIG. 10, the pre-nip N1 is formed by the simple contact between the fixation belt 13 and pressure roller 14, being therefore advantageous in that the heat which the fixation belt 13 and pressure roller 14 have can be efficiently transmitted to the recording medium P.

In the pre-nip N1, the recording medium P remains pinched between the peripheral surface of the pressure roller 14 and the outward surface of the fixation belt 13 by the "resiliency of the fixation belt 13" as described above. Therefore, the top and bottom surfaces of the recording medium P are uniformly pressured and preheated across their entirety.

The toner image T on the recording medium P is sufficiently heated for the toner image T to reach the fixation temperature level, in the pre-nip N1 which is continuous to the pressure nip N2. In the pressure nip N2, the toner image T on the recording medium P is conveyed through the pressure nip N2 while remaining under the pressure from the outward surface of the fixation belt 13 and the peripheral surface of the pressure roller 14. Thus, the toner image T on the recording medium P is thermally fixed to the surface of the recording medium P so that the toner image T remains satisfactorily fixed, and also, that the toner image T has a proper level of glossiness. That is, such temperature distribution and pressure distribution that fix the toner image T with the application of pressure after securing a sufficient length of time for satisfactorily melting the toner image T in the pre-nip N1 are obtained by the combination of the pre-nip N1 and pressure nip N2. Therefore, the fixing apparatus 112 in this embodiment is significantly less in the occurrence of the failure of the fixation of the toner image T, blisters, offsets, and the like, than a conventional fixing apparatus.

Then, the recording medium P is discharged from the pressure nip N2.

In the case of a fixing apparatus, such as the fixing apparatus 112 in this embodiment, which directly heats the fixation belt 13 with the use of an inductive heating method, the component to be heated is only the fixation belt 13. Therefore, it is substantially shorter in warm-up time than a conventional fixing apparatus.

Also in the case of the fixing apparatus 112 in this embodiment (third preferred embodiment), the pressure distribution in its fixation nip N was measured with the use of the pressure distribution measuring system PINCH (product of Nitta Co., Ltd.).

The pressure distribution in its fixation nip N measured when the combination of the pressure sensor and a sheet of thin recording medium (ordinary paper which is 75 g/m$^2$ in basic weight) was conveyed through the fixation nip N while remaining pinched in the fixation nip was the same as the pressure distribution (FIG. 6) in the fixation nip N of the fixing apparatus 112 in the first preferred embodiment measured when the combination of the pressure sensor and a sheet of thin recording medium P was conveyed through the fixation nip N while remaining pinched in the fixation nip N. The pressure distribution in its fixation nip N measured when the combination of the pressure sensor and a sheet of thick recording medium P (ordinary paper which is 220 g/m$^2$ in basic weight) was conveyed through the fixation nip N while remaining pinched in the fixation nip N was the same as the pressure distribution (FIG. 6) in the fixation nip N of the fixing apparatus 112 in the first preferred embodiment measured when the combination of the pressure sensor and a sheet of thick recording medium P was conveyed through the fixation nip N while remaining pinched in the fixation nip N.

[Tests]

The fixing apparatuses in the first to third preferred embodiment, and the first and second comparative fixing apparatuses were evaluated in nonuniformity in glossiness, and density, by outputting the following toner image samples.

Unfixed toner image samples were formed on recording medium P so that the amount of toner on the recording medium P became 0.45±0.01 mg/m$^2$. The fixing apparatuses were adjusted so that the surface temperature level of their fixation roller 1 or fixation belt 13 became 180° C. Then, the unfixed toner image samples were thermally fixed to the recording mediums P by conveying them through the fixation nip N of each of the above described fixing apparatuses at a process speed of 300 mm/sec.

Figure 13:
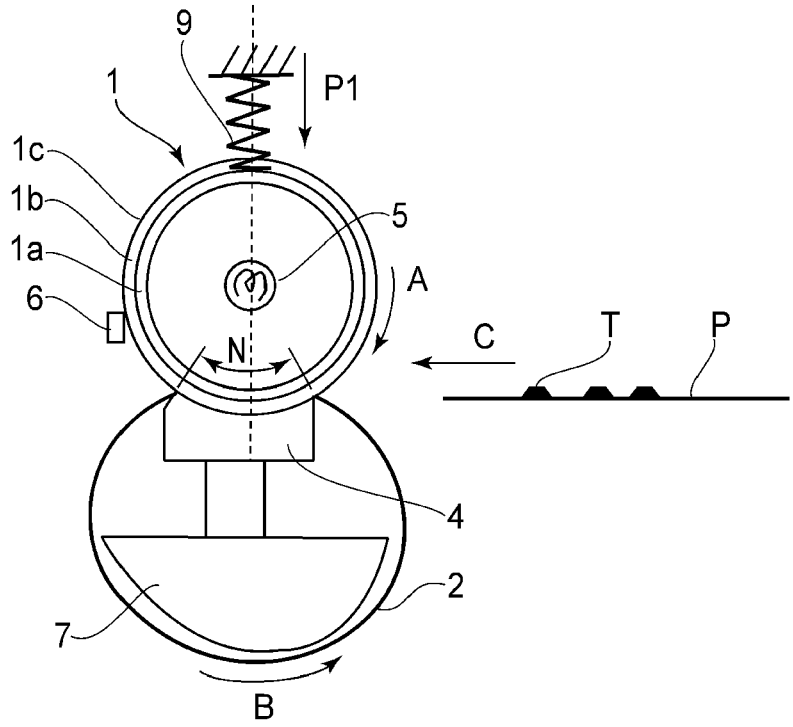
FIG.13 PRIOR ART
FIG. 13 is a sectional drawing of a first comparative fixing apparatus, and shows the structure thereof.
Figure 14:
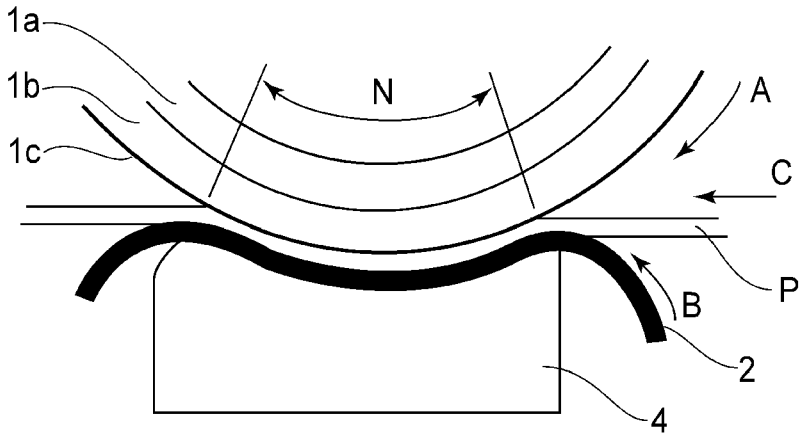
FIG.14 PRIOR ART
FIG. 14 is a sectional drawing of a fixation nip of the first comparative fixing apparatus, while a sheet of coated thin recording paper is conveyed through the fixation nip.
Figure 15:
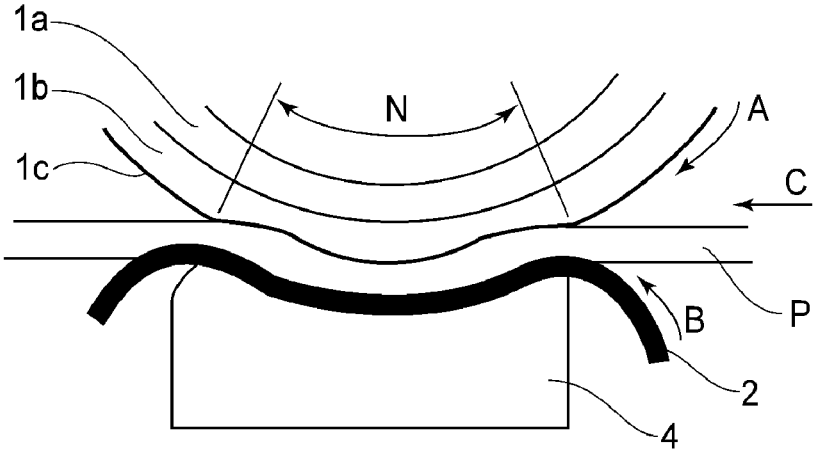
FIG.15 PRIOR ART
FIG. 15 is a sectional drawing of a fixation nip of the first comparative fixing apparatus, while a sheet of coated thick recording paper is conveyed through the fixation nip.
Figure 16:
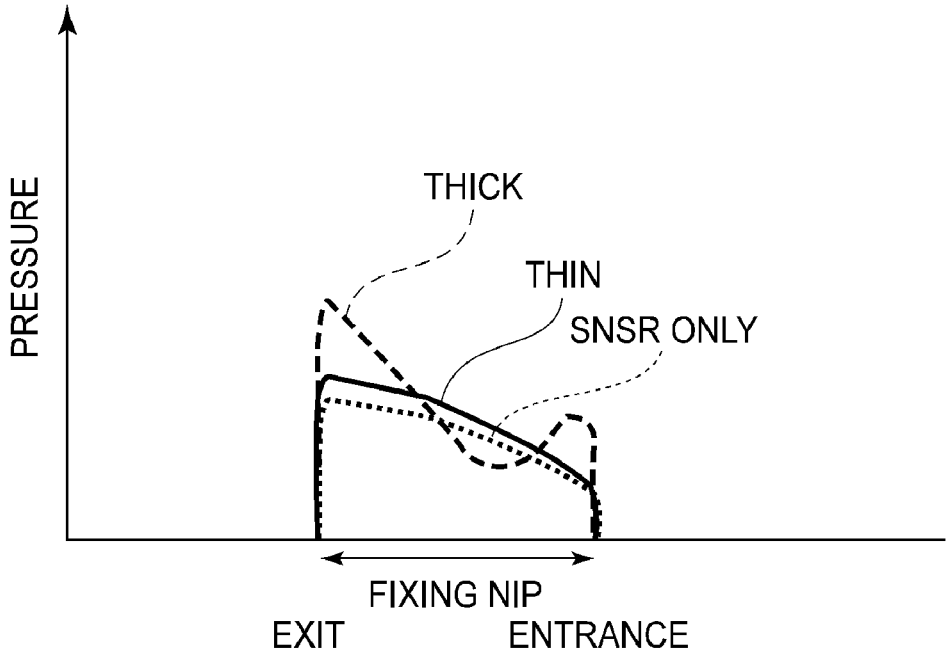
FIG.16 PRIOR ART
FIG. 16 is a graphical drawing which shows the pressure distribution of the fixation nip of the first comparative fixing apparatus.

The first comparative fixing apparatus shown in FIG. 13 was structured so that it became the same in the width of its fixation nip N as the fixing apparatus in each of the first to third preferred embodiments.

Figure 17:
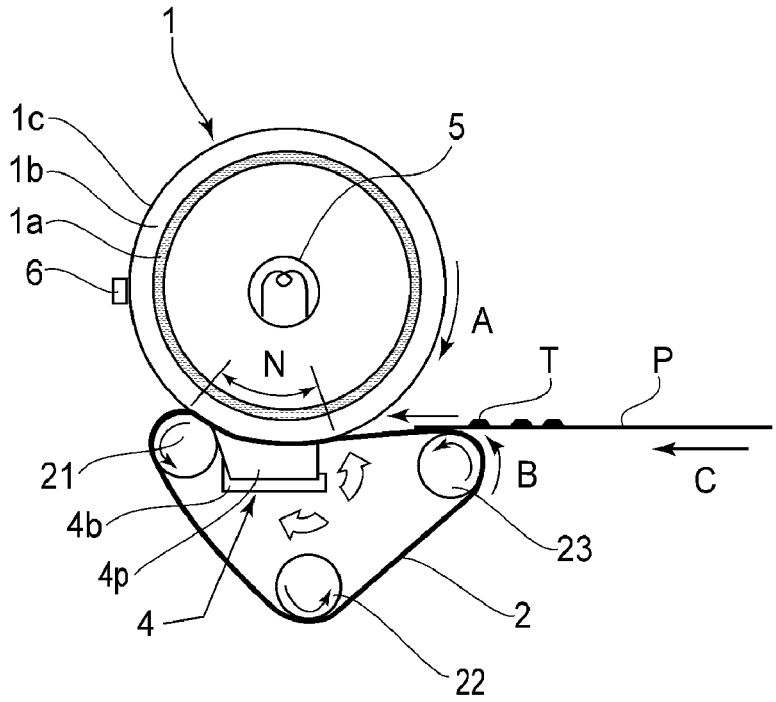
FIG.17 PRIOR ART
FIG. 17 is a sectional drawing of a second comparative fixing apparatus, and shows the structure of the fixing apparatus.
Figure 18:
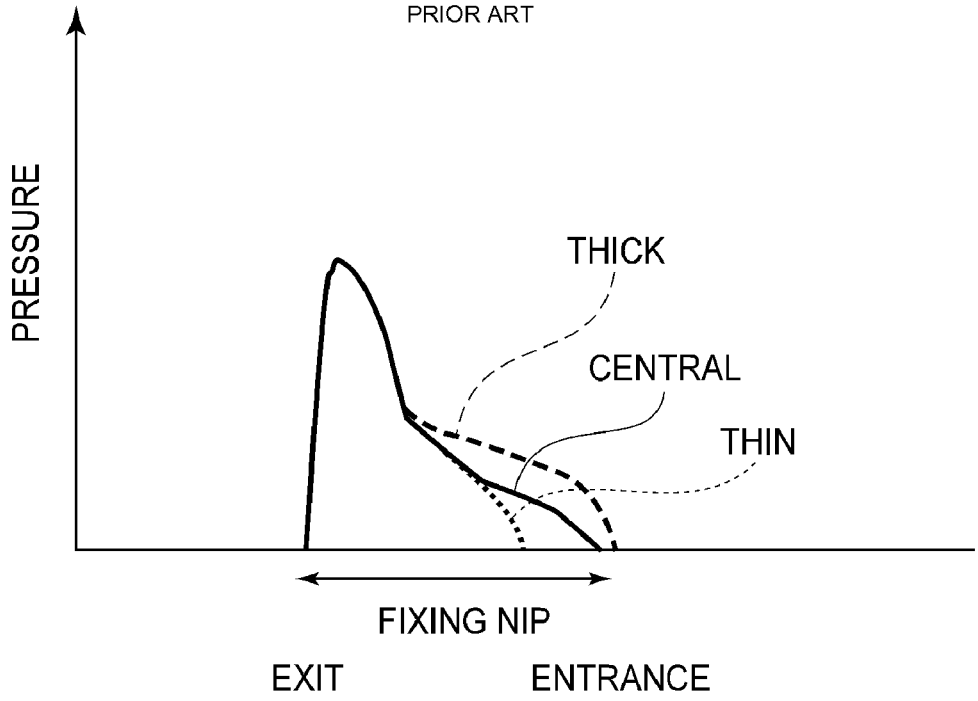
FIG.18 PRIOR ART
FIG. 18 is a graphical drawing which shows the pressure distribution of the fixation nip of the second comparative fixing apparatus.

The second comparative fixing apparatus shown in FIG. 17 was structured so that it operates in the thin recording medium mode, medium thickness recording medium mode, or thick recording medium mode, based on the type and basic weight of recording medium P, and also, so that its fixation nip N is varied in pressure distribution, based on whether its operational mode is in the thin recording medium mode, medium thickness recording medium mode, or thick recording medium mode. Referring to FIG. 17, in the thick recording medium mode, the pressure pad 4 was rotationally moved in the counterclockwise direction to increase in pressure the entrance side of the fixation nip N in terms of the recording medium conveyance direction C. However, the width of the fixation nip N when the fixing apparatus was in the thick recording medium mode was roughly the same as that when the fixing apparatus was in the medium thickness recording medium mode (FIG. 18). In a case where ordinary paper or coated paper was used as the recording medium P, the fixing apparatus was operated in the thin recording medium mode as long as the recording medium P was no more than 70 g/m$^2$ in basic weight. The medium thickness recording medium mode was used when recording paper which was no less than 70 g/m$^2$ and no more than 150 g/m$^2$ in basic weight was used as the recording medium P. The thick recording medium mode was used when recording medium P which was no less than 150 g/m$^2$ was used as the recording medium P.

The operation of the pressure pad 4 of the second comparative fixing apparatus when the fixing apparatus was in the thick recording medium mode was opposite to that of the pressure pad 4 of the fixing apparatus 112 in the second preferred embodiment. Also in the case of the second comparative fixing apparatus, the width of its fixation nip N when it was in the medium thickness recording medium mode and thick recording medium mode were the same as the width of the fixation nip N of the fixing apparatus 112 in each of the first to third preferred embodiments.

[Toner Image Evaluation in Glossiness Nonuniformity]

The toner images fixed under the above described conditions were evaluated in terms of glossiness nonuniformity. More concretely, sheets of coated paper, which were A4 in size and 80 g/cm$^2$ in basic weight, sheets of coated paper, which were A4 in size and 148 g/m in basic weight, and sheets of coated paper, which were A4 in size and 300 g/m$^2$ in basic weight, were used as the recording mediums P, and the toner images formed on the recording mediums P were visually evaluated in their nonuniformity in glossiness after their thermal fixation. The results are given in Table 1.

TABLE 1

| Basis weight of recording sheet | Coated sheet 80 g/m$^2$ | Coated sheet 148 g/m$^2$ | Coated sheet 300 g/m$^2$ |
|---|---|---|---|
| Embodiments. 1-3 | G | G | G |
| Comp. Ex. 1 | G | G | N |
| Comp. Ex. 2 | G | G | G |

[Evaluation References]

G: No glossiness unevenness is produced.

N: Glossiness unevenness is produced

It is evident from the results given in Table 1 that in the case of the fixing apparatuses in the first to third preferred embodiments and the second comparative fixing apparatus, no glossiness nonuniformity occurred when the above described three different coated papers were used, but, in the case of the first comparative fixing apparatus, the glossiness nonuniformity occurred when the coated thick papers, which were 300 g/m$^2$ in basic weight, were used.

As for the cause of the above described results, the "pressure dip" occurred when a sheet of coated thick paper, which was 300 g/m$^2$ in basic weight, was conveyed through the first comparative fixing apparatus. In the case of the fixing apparatuses different in structure from the first comparative fixing apparatus, no glossiness nonuniformity occurred when the above-described three coated papers, which were different in basic weight, were used.

[Toner Image Evaluation in Density]

The toner images fixed under the above described conditions were evaluated in terms of density. More concretely, sheets of ordinary paper, which were A4 in size and 75 g/cm$^2$ in basic weight, sheets of ordinary paper, which were A4 in size and 150 g/m$^2$ in basic weight, sheets of ordinary paper, which were A4 in size and 220 g/m$^2$ in basic weight, and sheets of ordinary paper, which were A4 in size and 300 g/m$^2$ in basic weight, were used as the recording mediums P, and 10 of each of the above described ordinary papers different in basic weight, on which the unfixed toner image was present, were conveyed in succession through the fixation nip N of each fixing apparatus. Then, the reflective density of the thermally fixed toner image on each of 10 sheets of ordinary paper was measured. Then, the average reflective density of the 10 fixed toner images was obtained and evaluated. As the evaluation of the image density, X-Rite (product of X-Rite Co., Ltd.) was used.

The results of the image density evaluation made with the use of the following evaluation symbols are given in Table 2. The fixing apparatus which was higher than G in evaluation had no problem.

TABLE 2

| Basis weight of recording sheet | Plain paper 75 g/m$^2$ | Plain paper 150 g/m$^2$ | Plain paper 220 g/m$^2$ | Plain paper 300 g/m$^2$ |
|---|---|---|---|---|
| Embodiments. 1-3 | E | E | E | E |
| Comp. Ex. 1 | F | F | N | N |
| Comp. Ex. 2 | E | E | G | G |

[Evaluation References]

E: Reflection density was no less than 1.5.

G: Reflection density was no less than 1.4, and no more than 1.5.

F: Reflection density was no less than 1.2, and no more than 1.4.

N: Reflection density was no more than 1.2.

It is evident from the results given in Table 2 that in the case of the first comparative fixing apparatus, its reflection density was slightly low when ordinary paper which is 75 g/m$^2$ in basic weight, and ordinary paper which is 150 g/m$^2$ in basic weight, were used, and the reflection density was very low when ordinary paper which was 220 g/m$^2$ in basic weight, and ordinary paper which was 300 g/m$^2$ in basic weight, were used. This reduction in reflection density occurred because in the case of the first comparative fixing apparatus, the length of time a toner image remained under pressure was long. In other words, the toner image was excessively pressed. Therefore, the toner on the surface of the ordinary paper infiltrated into the fibrous surface layers. Thus, the fibers appeared at the surface of the toner image, and caused the toner image to reduce in reflection density.

In the case of the second comparative fixing apparatus, when ordinary paper which was 220 g/m$^2$ in basic weight, and ordinary paper which was 300 g/m$^2$ in basic weight, were used, the reflection density was slightly lower compared to the fixing apparatuses 112 in the first to third preferred embodiments, although the reflection density was not low enough to create problems in practical terms. This reduction in reflection density occurred for the following reason. That is, in a case where the second comparative fixing apparatus was used with thick ordinary paper, the internal pressure of its fixation nip N was increased by the thick ordinary paper, and therefore, the amount of the pressure applied to the toner image in the fixation nip N of this fixing apparatus was slightly higher than those applied in the fixation nips N of the fixing apparatuses 112 in the first to third preferred embodiments. Therefore, the fibrous surface layer of the thick ordinary paper was partially infiltrated by the toner. Thus, the fibers appeared at the top surface of the toner image, and therefore, slightly reduced the toner image in image density.

In the case of the fixing apparatuses 112 in the first to third preferred embodiments, the infiltration of toner into the fibrous surface layer of recording medium was not as bad as that in the case of the first and second comparative fixing apparatus, and therefore, the images outputted by the former were higher in reflective density than those outputted by the latter. This occurred for the following reason. In the case of the fixing apparatuses 112 in the first to the third preferred embodiments, the width of the pre-nip N1 of the fixation nip N, and the width of the pressure nip N2 of the fixation nip N, were kept constant whether the recording medium P conveyed through the fixation nip N was thin or thick (FIG. 6). Even when the recording medium P changed in thickness in the fixation nip N, the amount by which heat was applied to the toner image on each recording medium P remained at an optimal level, and so was the amount by which pressure was applied to the toner image T on each recording medium P.

As will be evident from the preceding description of the first to third preferred embodiments of the present invention, the present invention can provide a wider fixation nip which can deal with the increase in the image formation speed, can deal with various recording mediums different in thickness, for example, thin recording medium as well as thick recording medium, can maintain a high level of fixation performance, can achieve a high level of image density, and can prevent the formation of abnormal images, that is, the images suffering from "image deviation" and "glossiness nonuniformity".

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 002379/2009 filed Jan. 8, 2009 which is hereby incorporated by reference.

What is claimed is:

1. A fixing apparatus for heat-fixing an unfixed toner image formed on a recording material, said fixing apparatus comprising:

a rotatable roller;

an endless belt contacted to said roller;

a pressing member contacted to an inner surface of said endless belt and cooperating with said roller to nip said endless belt, wherein the recording material on which the unfixed toner image is formed is heated while being nipped and fed by a nip between said roller and said endless belt, wherein such a surface of said pressing member as is opposed to the inner surface of said endless belt is curved substantially in the same direction as a curved surface of said roller, wherein the nip includes a first nip region in which said endless belt is not pressed by said pressing member and said endless belt is contacted to said roller by an elastic force of said endless belt which is in a slack state, and a second nip region in which said endless belt is contacted to said roller by pressing of said pressing member, wherein the nip starts with the first nip region with respect to a feeding direction of the recording material, and wherein the second nip region is continuous with the first nip region.

2. An apparatus according to claim 1, wherein the surface of said pressing member opposed to said endless belt has a radius of curvature which is larger than that of said roller.

3. An apparatus according to claim 1, wherein said pressing member is rotatable about a downstream portion with respect to the feeding direction.

4. An apparatus according to claim 3, wherein said pressing member is rotated by the recording material entering the nip.

5. An apparatus according to claim 3, further comprising a driving mechanism for rotating said pressing member in accordance with a kind of the recording material.

* * * * *